US009422843B2

(12) United States Patent
Barrett et al.

(10) Patent No.: US 9,422,843 B2
(45) Date of Patent: Aug. 23, 2016

(54) RESONANCE GENERATING MUFFLER

(71) Applicants: Michael Wayne Barrett, Marshfield, MO (US); Andrew Michael Barrett, Marshfield, MO (US)

(72) Inventors: Michael Wayne Barrett, Marshfield, MO (US); Andrew Michael Barrett, Marshfield, MO (US)

( * ) Notice: Subject to any disclaimer, the term of this patent is extended or adjusted under 35 U.S.C. 154(b) by 0 days.

(21) Appl. No.: 14/020,877

(22) Filed: Sep. 8, 2013

(65) Prior Publication Data

US 2015/0068834 A1 Mar. 12, 2015

(51) Int. Cl.

| | |
|---|---|
| ***F01N 1/20*** | (2006.01) |
| ***F01N 1/16*** | (2006.01) |
| ***F01N 1/02*** | (2006.01) |
| *F01N 1/00* | (2006.01) |

(52) U.S. Cl.

CPC ..... *F01N 1/026* (2013.01)

(58) Field of Classification Search

USPC ..... 181/264, 268, 270, 275, 277, 249, 252, 181/271; 116/137 R, 138

See application file for complete search history.

(56) References Cited

U.S. PATENT DOCUMENTS

| | | | | | |
|---|---|---|---|---|---|
| 582,485 | A * | 5/1897 | Reeves et al. | 181/267 | |
| 2,512,155 | A * | 6/1950 | Hill | F01N 1/00 | 181/249 |
| 4,055,231 | A * | 10/1977 | Martinez | 181/241 | |
| 4,228,868 | A * | 10/1980 | Raczuk | 181/247 | |
| 4,424,882 | A * | 1/1984 | Moller | F01N 1/023 | 181/231 |
| 4,574,914 | A * | 3/1986 | Flugger | 181/268 | |
| 4,763,471 | A * | 8/1988 | Keller | 60/312 | |
| 4,923,035 | A * | 5/1990 | Keller | 181/228 | |
| 5,198,601 | A * | 3/1993 | McCabe | G10D 3/146 | 84/298 |
| 5,214,254 | A * | 5/1993 | Sheehan | 181/241 | |
| 5,434,374 | A * | 7/1995 | Hsueh | 181/228 | |
| 5,449,866 | A * | 9/1995 | Moss | 181/228 | |
| 5,524,354 | A * | 6/1996 | Bartzke | G01B 7/012 | 33/558 |
| 5,854,453 | A * | 12/1998 | Fujiwara | E01F 8/0058 | 181/286 |
| 6,158,472 | A * | 12/2000 | Hilgert | 138/26 | |
| 6,484,843 | B2 * | 11/2002 | Yoshii | H04R 1/345 | 181/153 |
| 6,591,939 | B2 * | 7/2003 | Smullin | F01N 1/084 | 181/260 |
| 6,679,351 | B2 * | 1/2004 | Cummings et al. | 181/212 | |
| 6,688,423 | B1 * | 2/2004 | Beatty et al. | 181/207 | |
| 7,017,610 | B2 * | 3/2006 | Zimpfer et al. | 138/30 | |
| 7,219,764 | B1 * | 5/2007 | Forbes | 181/270 | |
| 2001/0015301 | A1 * | 8/2001 | Kesselring | 181/249 | |
| 2004/0108162 | A1 * | 6/2004 | Couvrette | 181/241 | |
| 2005/0161281 | A1 * | 7/2005 | Klinkert et al. | 181/233 | |
| 2015/0047921 | A1 * | 2/2015 | Disimile | F04B 11/00 | 181/264 |
| 2015/0060194 | A1 * | 3/2015 | Pongratz | G10K 11/172 | 181/286 |

FOREIGN PATENT DOCUMENTS

| | | | | |
|---|---|---|---|---|
| DE | 102008046870 | * | 11/2009 | F01N 1/04 |
| JP | 55146214 A | * | 11/1980 | F01N 1/02 |
| JP | 59012111 A | * | 1/1984 | |
| JP | 07166836 A | * | 6/1995 | |
| JP | 2002168110 A | * | 6/2002 | |

* cited by examiner

*Primary Examiner* — Edgardo San Martin
(74) *Attorney, Agent, or Firm* — Dale J. Ream

(57) ABSTRACT

In accordance with at least one embodiment: a muffler with a case (comprised of at least one inlet, at least one outlet, and a body), and elongated members comprised of material capable of a predetermined resonance. The elongated members have sufficient length after their final point of attachment to vibrate when exposed to flowing exhaust gasses. This vibration results in resonance that is noise canceling and/or sound enhancing. The muffler may also contain any combination of sound baffles, sound absorbent material, and other sound altering devices.

16 Claims, 25 Drawing Sheets

RESONANCE GENERATING MUFFLER

BACKGROUND

Prior Art

The following is a tabulation of various prior art that appears presently relevant:

| U.S. Patents | | | |
|---|---|---|---|
| Pat. No. | Kind Code | Issue Date | Patentee |
| 582,485 | (N/A) | May 5, 1897 | Reeves, Reeves |
| 4,574,914 | A | Mar. 3, 1986 | Flugger |
| 7,219,764 | B1 | May 22, 2007 | Forbes |
| 1,029,162 | B1 | Mar. 23, 2005 | Flugger |
| 5,434,374 | A | Jul. 18, 1995 | Tien-Chu Hsueh |
| 20040108162 | A1 | Jun. 10, 2004 | Gilles Couvrette |

Nonpatent Literature Documents

Wilder, Jim, *Undercar Digest*, "A Different Muffler, Going to Market Differently" (April 2009)

Since the advent of the internal combustion engine, people have sought to control its sound. Milton and Marshall Reeves were presumably the first to address this dilemma; their patent for "Exhaust-Muffler For Engines" was issued in 1897. Their muffler, along with other mufflers of the time (and today), was intended only to attenuate sound. Over time, a significant demand grew for mufflers with pleasing sound and greater exhaust gas flow. Greater flow results in better engine performance and increased fuel economy, but is difficult to achieve in mufflers due to the back-pressure created by manipulating exhaust. Muffler manufactures responded to the demand for greater flow with a limited degree of success.

Several designs (such as Flugger's) have sought to achieve low back-pressure, and (perhaps to a lesser extent) pleasing sound. Low back pressure (greater flow) results in better engine performance and increased fuel economy, but there is a limit on how much flow can be achieved. Virtually all mufflers rely on either physically altering the path of exhaust gasses (passive-reactive type), using sound absorbent material (absorptive type), or both. Due to this, undesirable back pressure is invariably created, and is particularly extreme on mufflers designed to fully silence.

Several ideas have been proposed to deal with the problem of back pressure, but virtually all fail to some degree. A particularly interesting proposition is the active-reactive muffler. In essence, active-reactive mufflers function by electronically monitoring the sound produced by exhaust, then sending noise canceling sound waves back into the exhaust system via a speaker. Although this seems promising at face value, it results in many new problems and limitations. Active-reactive mufflers have existed for decades, but have seen comparatively little commercial success. Reasons for this include:

(a) The sheer sophistication of the system results in the risk of component failure; the computer could malfunction, the sensors could degrade in the presence of exhaust gasses and heat, the speaker could rupture, the cables could corrode, etc.

(b) The expense of implementing such a system is typically much greater than a traditional muffler.

(c) It is likely unfeasible or perhaps impossible to selectively control sound cancellation well enough to compete in the performance exhaust market.

(d) It is difficult to account for different types of engines, and therefore difficult or impossible to fully incorporate into the aftermarket.

Amongst engine and automobile enthusiasts, we have found that pleasing sound is at least as important as exhaust flow. Although modern performance mufflers offer more sound than mufflers intended for silencing, there are still many problems that plague the industry. Attempts at correcting these problems have been mediocre at best.

A particularly notorious problem among exhaust (especially performance exhaust) is what is popularly known as "drone". Especially prominent among "welded-type" mufflers (such as Flugger's), drone refers to a sustained low frequency tone that can be heard at certain RPMs. This noise is usually perceived as irritating and undesirable. Some mufflers are less prone to this problem, but have other problems in its place. Forbes has recently found a possible, partial solution to drone, but offers no indication that any other issues are addressed.

Another common problem we have found among performance mufflers is a popping sound, which usually occurs during rapid drops in RPM (such as releasing the accelerator pedal). This phenomenon is created by pockets of exhaust gasses building and releasing. This can be caused by engine issues, back-pressure, low pressure zones in mufflers, and a plethora of other variables. This problem is often exacerbated by tail pipes. Popping exhaust is a fairly common problem, but extremely difficult to circumvent with mufflers designed for medium to loud volume.

We have found that a lack of refined sound (a "muddy" tone) is extremely common across the entire performance muffler spectrum, and is often perceived among consumers as "unnatural", "undesirable", or just plain "ugly". This is because it is difficult to improve the underwhelming sounds of a damaged or non-performance engine via exhaust. Although some attempts have been made to offer performance sound to stock and/or aging engines, we have found the results to be lackluster at best. While it is true that some muffler designs may make engine problems less audible, we have found that the sound is not at all comparable to a true performance engine.

Advantages

Accordingly, several advantages for one or more aspects are as follows: a muffler that has extremely low back-pressure, is highly reliable, is suitable for a wide variety of markets, that addresses problems such as "drone" and "popping", that provides a crisp and natural sound, and that potentially corrects undesirable sounds produced by an engine. Other advantages of one or more aspects will become apparent after consideration of the drawings and ensuing description.

SUMMARY

In accordance with at least one embodiment: a muffler with a case comprising a body, at least one inlet, and at least one outlet. A plurality of elongated members produce resonance when subjected to flowing exhaust gasses, which results in noise canceling and/or sound enhancing tones. Sound altering devices, such as sound baffles, sound absorbent material, and/or electronic noise canceling may be used in addition to the elongated members.

GLOSSARY OF TECHNICAL TERMS

Absorptive Muffler: A muffler that utilizes sound absorption.

Active-Reactive Muffler: A muffler that utilizes electronic sound cancellation.

Aftermarket: The market in which third-party parts companies compete.

Attenuation: To reduce sound levels.

Back Pressure: Restriction in the exhaust of an engine.

Body: In this specification, the body is the main section of a muffler. It typically (but not always) houses most or all of the internal components. A body is part of a case.

Branches: In this specification, "branches" refers to elongated members that stem from other elongated members.

Case: In this specification, the case is the body, inlet, and outlet of a muffler.

Cylinder: A three dimensional shape with straight parallel sides and a circular or oval section.

Drone: A sustained, usually low frequency tone that is typically considered undesirable.

Elongated Members: In this specification, "elongated members" refers to elongated members possessing resonating properties (refer to detailed description and operation for FIG. 1, and claims for a specificities).

Holding Ring: A device that allows components to attach to the case.

Inlet: The entrance of a muffler. Part of the case.

Muffler: A device that alters the sound of exhaust produced by an internal combustion engine.

Outlet: The exit of a muffler. Part of the case.

Passive-Reactive Muffler: A muffler that utilizes sound deflection.

Perforation: Holes in an object.

Polyhedron: A three dimensional shape with multiple sides.

Popping: An undesirable sound that can occur in exhaust systems, particularly during rapid drops in RPM.

Resonance: Sound created as a reaction from a stimulus.

(Sound) Absorption: To absorb sound (through materials such as fiberglass, steel wool, etc.) for the purpose of noise canceling and/or altering tone.

(Sound [or Deflection]) Baffle: A device used to create sound deflection.

(Sound) Deflection: Manipulating the path of sound waves to create sound canceling effects.

Suspend: To hang.

Tail Pipe: Exhaust pipe after a muffler.

DRAWINGS

Figures

DRAWINGS

Reference Numerals

Figure 1:
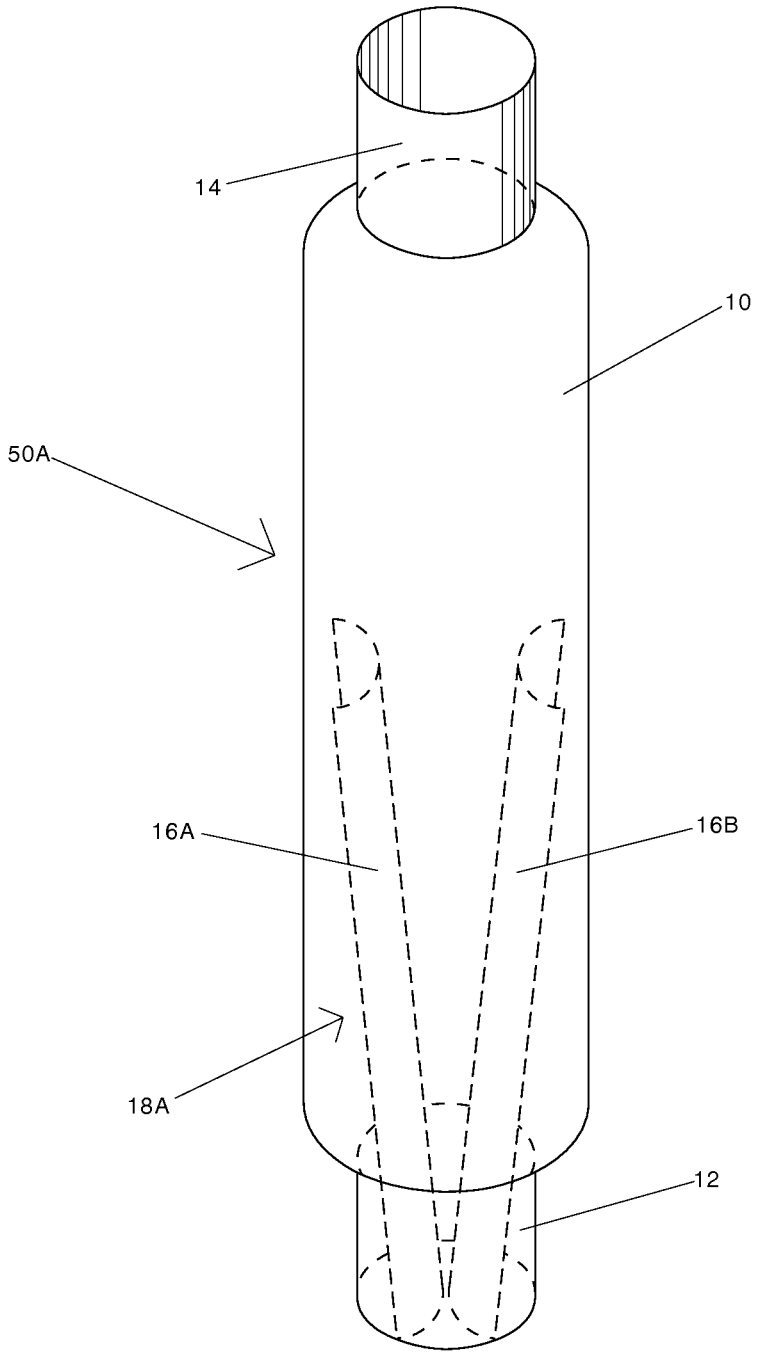
FIG. 1 shows a perspective view of the first embodiment, with two elongated members, and a small cylindrical-bodied case.

50A: small cylindrical-bodied case
50B: large cylindrical-bodied case
50C: polyhedral-bodied case
10: small cylindrical body
10B: large cylindrical body
10C: polyhedral body
12: inlet
14: outlet
16A-16MM: elongated member
18A-18M: elongated member assembly
20: deflection baffle
24: oval deflection baffle
26: suspended "v"-shaped deflection baffle
28A-28D: holding ring
30: body-mounted "v"-shaped deflection baffle
32: sound absorbent material
34: baffle assembly
36: baffle assembly front cradle
38: baffle assembly holding ring
40: perforated baffle 1
42: perforated baffle 2
44: perforated baffle 3

DETAILED DESCRIPTION

FIG. 1—First Embodiment

One embodiment of the muffler is illustrated as a perspective view in FIG. 1. The figure shows a small cylindrical-bodied case 50A, comprised of a small cylindrical body 10, an inlet 12, and an outlet 14. An elongated member assembly 18A, comprised of two elongated members 16A and 16B, is attached inside the inlet 12. The elongated members 16A and 16B are made of steel in this embodiment, but can be made of any material capable of sufficient resonance. The elongated members in this embodiment are partial cylinders.

OPERATION

FIG. 1—First Embodiment

When the inlet 12 is attached to the exhaust system of an engine (not shown), exhaust gasses are allowed to pass through the small cylindrical-bodied case 50A. As the gasses (and their sound waves) pass by elongated member assembly 18A, elongated members 16A and 16B respond by vibrating. This is possible because the members are made of a resonant material (in this embodiment, steel), and because they extend sufficiently past their final attaching point (in this embodiment, the inlet 12). As a result of the vibrations, resonant tones are generated. These resonant tones can be noise canceling, sound enhancing, or both. Because the members are directly excited by the exhaust gasses, the tones generated are directly correlated to the natural sound of the exhaust. The members are capable of producing sound waves opposite of some or all of those produced by an engine. This phenomenon results in the sound waves collapsing, creating noise cancellation. It is also possible for the members to generate additive tones when vibrating, which results in a more pleasing sound. Because there is very little to physically get in the way of exhaust gasses, back-pressure is extremely low. As of this time, we have found that 2 half-pipe-shaped steel members about 20 centimeters long works well across a wide variety of applications for a combination of noise canceling and pleasing sound. However, the device is not limited to these specifications in any way. Different materials, lengths, shapes, different numbers of members, etc. can be used.

DETAILED DESCRIPTION

Figure 2:
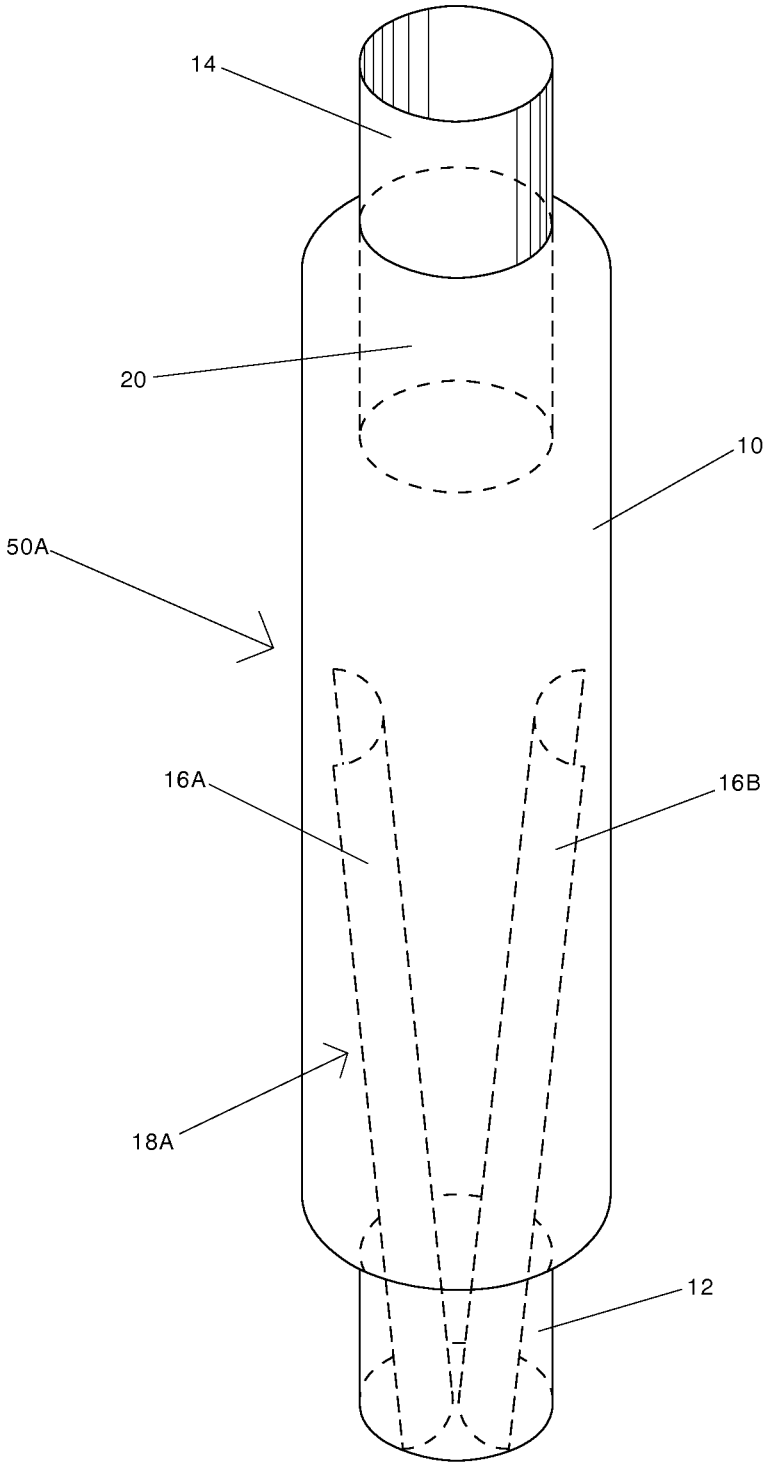
FIG. 2 shows an embodiment with a deflection baffle.

FIG. 2—Second Embodiment

FIG. 2 shows the same elements as FIG. 1, with the addition of a deflection baffle 20.

OPERATION

FIG. 2—Second Embodiment

After passing by elongated member assembly 18A (the effect described in the operation of FIG. 1), some of the exhaust gasses flow directly out of the case 50A, while some are forced to the sides of deflection baffle 20, where they deflect between the baffle and the small cylindrical body 10. This results in further noise cancellation. The gasses eventually flow out of the case 50A via the outlet 14.

DETAILED DESCRIPTION

Figure 3:
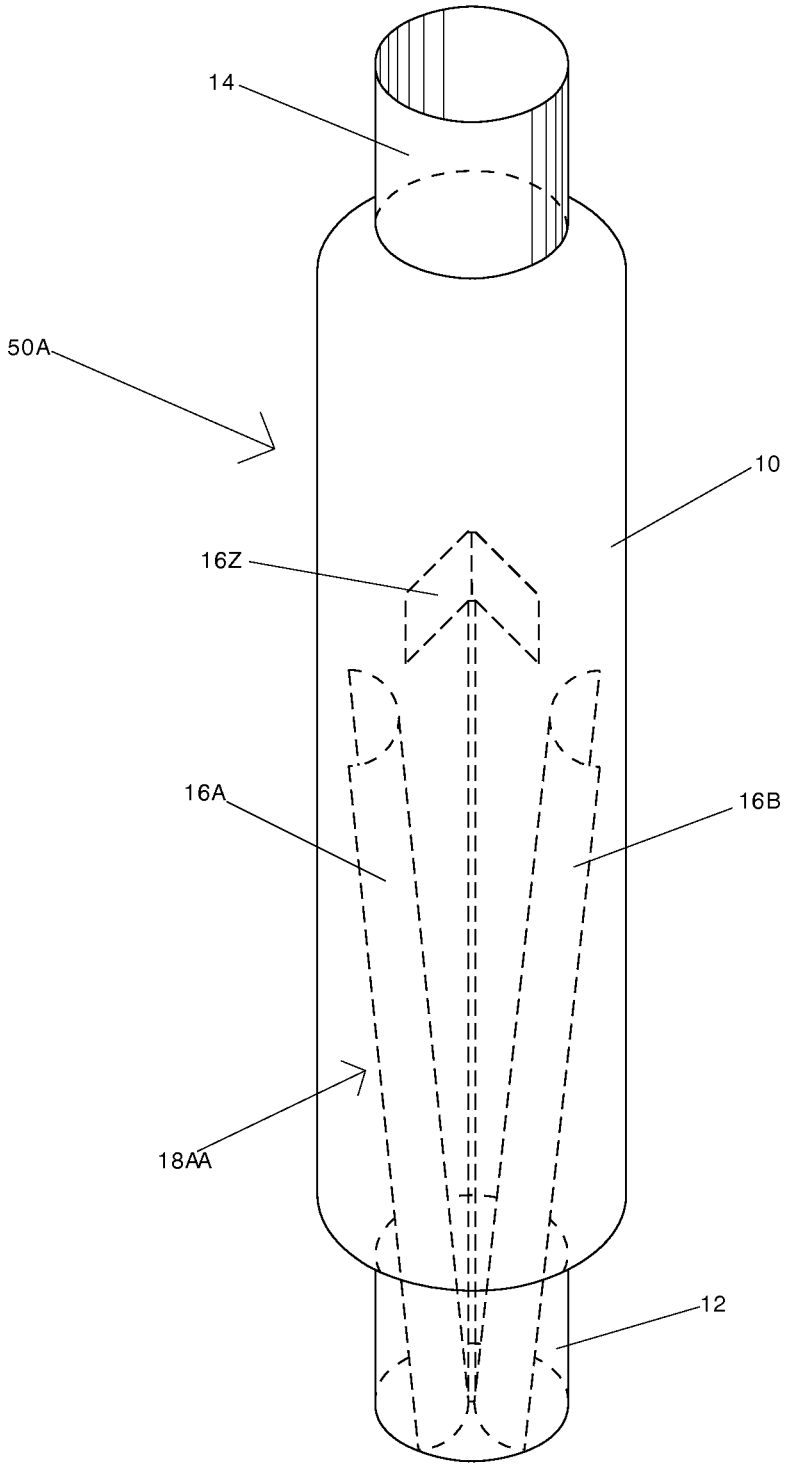
FIG. 3 shows an embodiment with a third elongated member.

FIG. 3—Third Embodiment

FIG. 3 shows the same elements as FIG. 1, with elongated member assembly 18AA in place of elongated member assembly 18A. Elongated members 16Z, 16A, and 16B make up elongated member assembly 18AA.

OPERATION

FIG. 3—Third Embodiment

As described in the operation of FIG. 1, elongated members 16A and 16B create resonance as exhaust gasses flow by them. The addition of elongated member 16Z changes the nature of the resonance. As well, the "v"-shaped tip of elongated member 16Z slows down the exhaust gasses, allowing them to be further altered.

DETAILED DESCRIPTION

Figure 4:
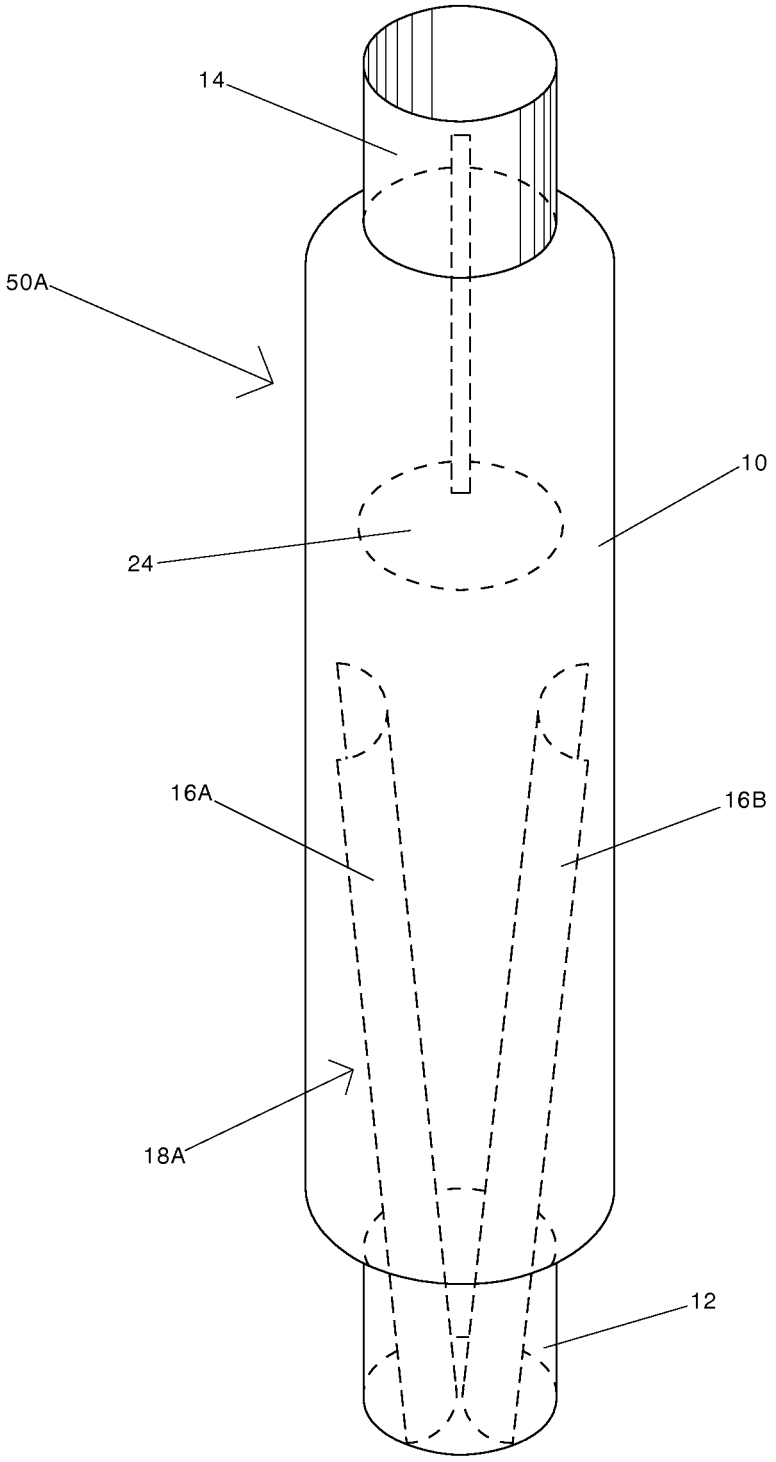
FIG. 4 shows an embodiment with an oval deflection baffle, stemming from an outlet.

FIG. 4—Fourth Embodiment

FIG. 4 shows the same elements as FIG. 1, with the addition of an oval deflection baffle 24 which is attached to the outlet 14 and protrudes into the small cylindrical body 10.

OPERATION

FIG. 4—Fourth Embodiment

After passing by elongated member assembly 18A, the flow of the exhaust gasses is interrupted by oval deflection baffle 24. Exhaust gasses are forced to go around the baffle, which slows down the flow, as well as creates noise canceling deflection between the baffle and the small cylindrical body 10.

DETAILED DESCRIPTION

Figure 5:
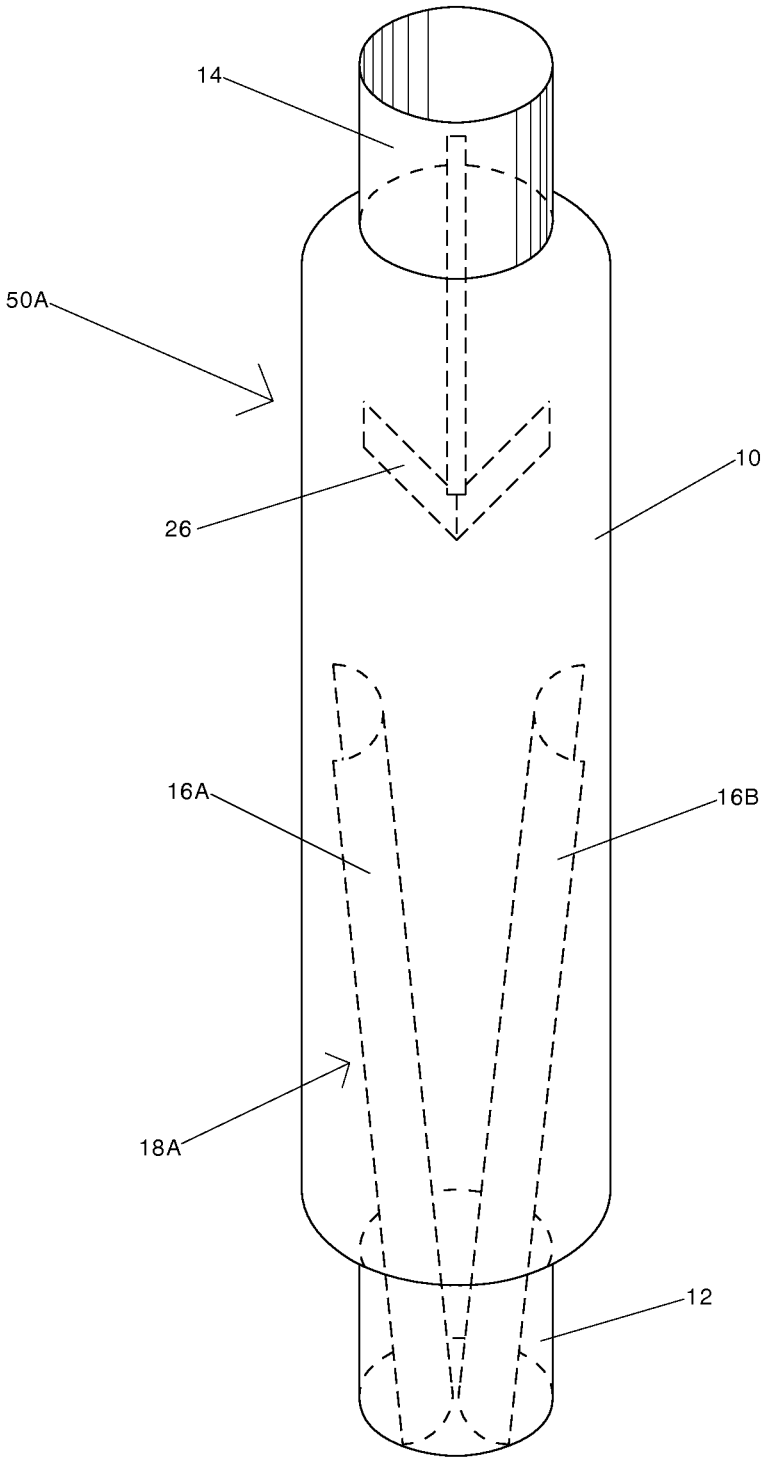
FIG. 5 shows an embodiment with a "v"-shaped deflection baffle, stemming from the outlet.

FIG. 5—Fifth Embodiment

FIG. 5 shows the same elements as FIG. 1, with the addition of a suspended "v"-shaped deflection baffle 26 which is attached to the outlet 14 and protrudes into the small cylindrical body 10.

OPERATION

FIG. 5—Fifth Embodiment

FIG. 5 operates the same as FIG. 4, with suspended "v"-shaped deflection baffle 26 in place of the oval deflection baffle 24. This results in different sound characteristics than other embodiments.

DETAILED DESCRIPTION

Figure 6:
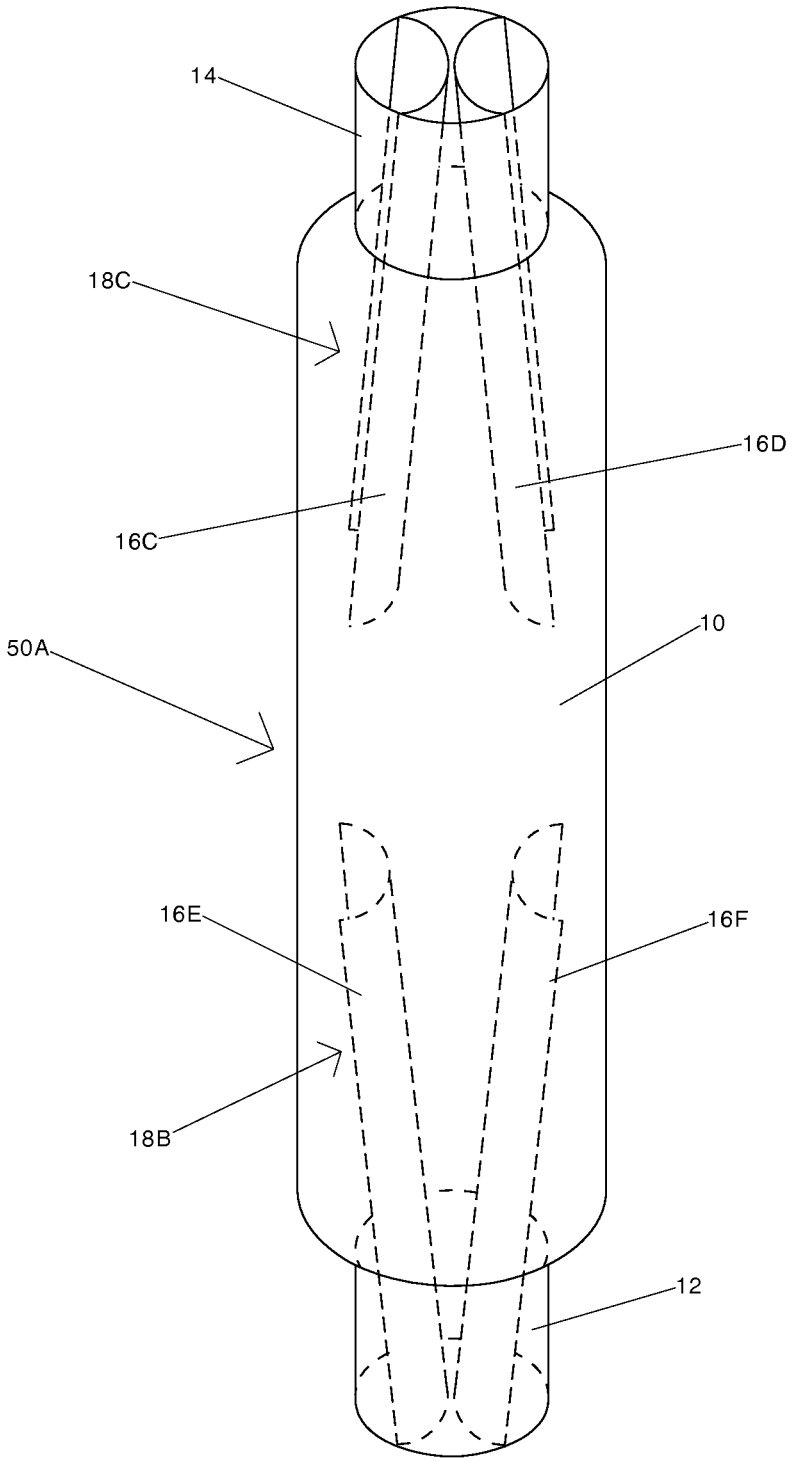
FIG. 6 shows an embodiment with multiple sets of elongated members.

FIG. 6—Sixth Embodiment

FIG. 6 shows the same elements as FIG. 1, with an elongated member assembly 18B (comprised of two elongated members 16E and 16F) in place of elongated member assembly 18A. In addition, another elongated member assembly 18C, comprised of elongated members 16C and 16D, is attached to the outlet 14.

OPERATION

FIG. 6—Sixth Embodiment

After passing by elongated member assembly 18B (functionally virtually the same as elongated member assembly 18A), the exhaust gasses are further altered by elongated member assembly 18C. Elongated member assembly 18C operates the same as elongated member assembly 18A, but is attached to the outlet 14, allowing the exhaust gasses to be further altered before exiting.

DETAILED DESCRIPTION

Figure 7:
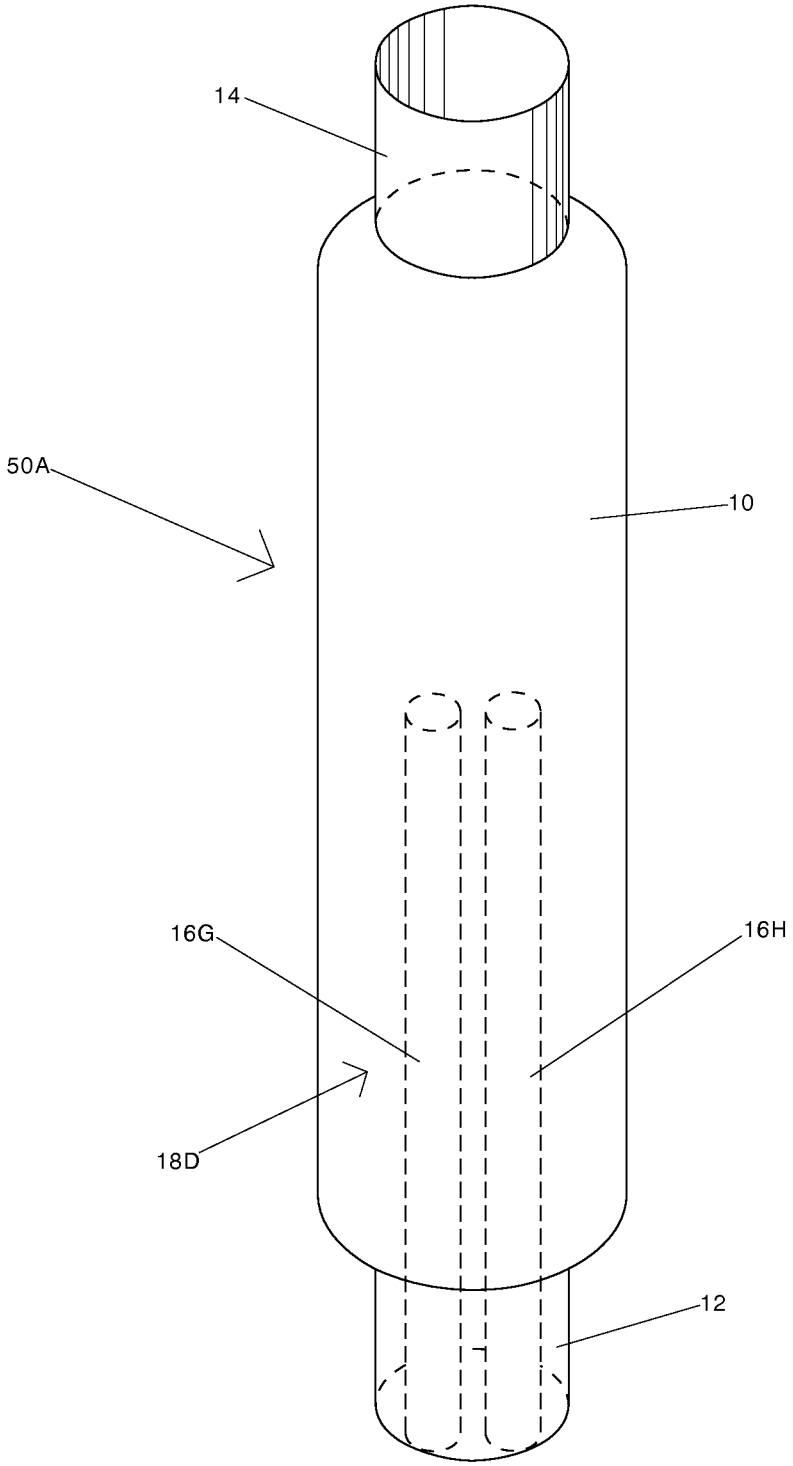
FIG. 7 shows an embodiment with cylindrical elongated members.

FIG. 7—Seventh Embodiment

FIG. 7 shows the same elements as FIG. 1, with an elongated member assembly 18D, comprised of two elongated members 16G and 16H, in place of elongated member assembly 18A. Elongated members 16G and 16H are both cylindrical in shape, open on both ends, and attached to the inlet 12.

OPERATION

FIG. 7—Seventh Embodiment

FIG. 7 operates the same as FIG. 1, but elongated members 16G and 16H are cylindrical, which allows exhaust gasses to flow through the members as well as by them. This results in different sound characteristics than those produced by other embodiments.

DETAILED DESCRIPTION

FIG. 8—EIGHT EMBODIMENT

Figure 8:
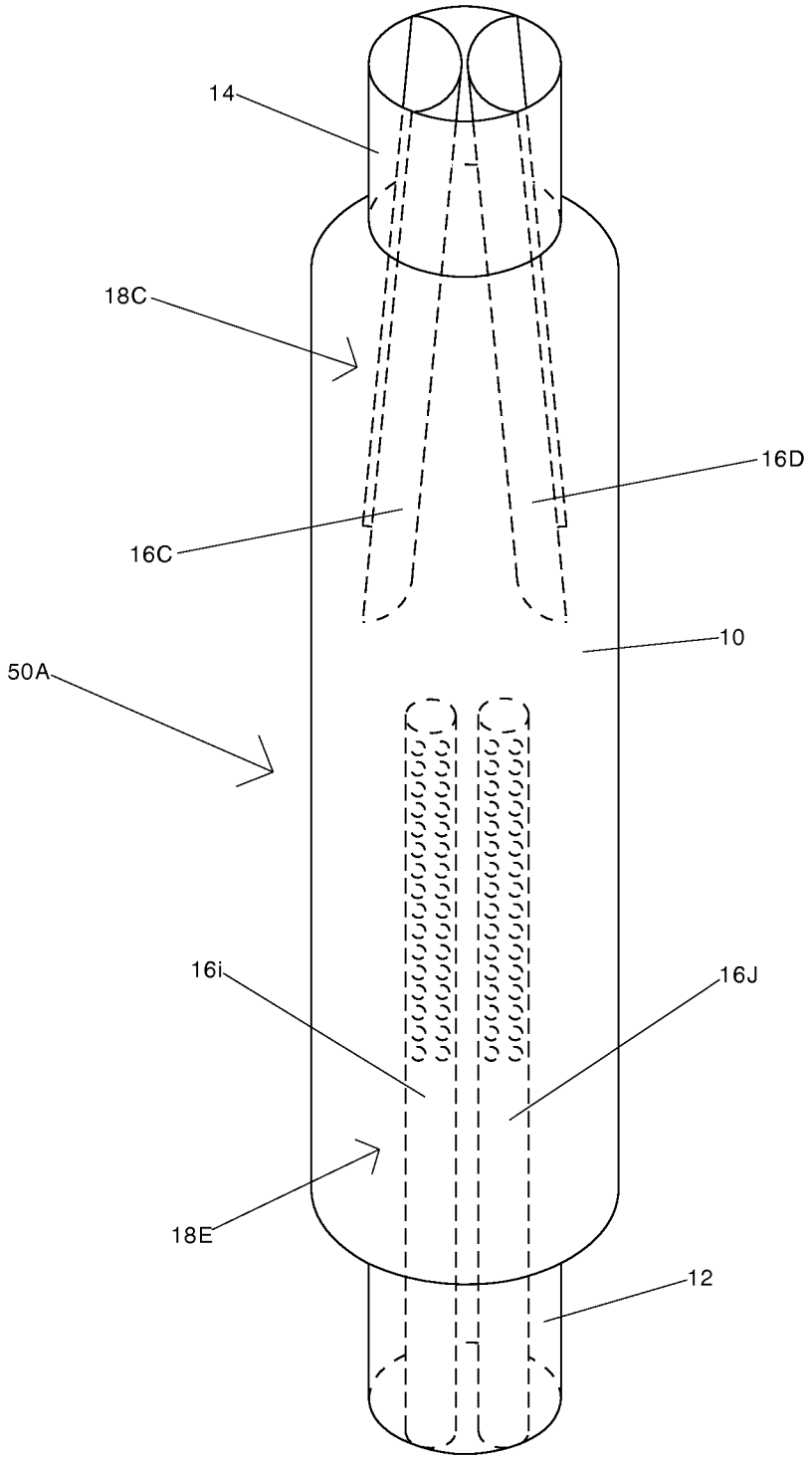
FIG. 8 shows an embodiment with a set of perforated cylindrical elongated members, and a set of non-cylindrical elongated members.

FIG. 8 shows small cylindrical-bodied case 50A, and an elongated member assembly 18E, comprised of two elongated members 16*i* and 16J, attached to the inlet 12. The elongated members 16*i* and 16J are both cylindrical in shape, open on both ends, and perforated. Another elongated member assembly 18C is attached to the outlet 14, and is comprised of elongated members 16C and 16D.

OPERATION

FIG. 8—Eighth Embodiment

FIG. 8 operates the same as FIG. 6, but with an elongated member assembly 18E replacing FIG. 6's elongated member assembly, 18B. Perforation allows exhaust gasses to flow in and out of the cylindrical members. This results in different sound characteristics than those produced by other embodiments.

DETAILED DESCRIPTION

Figure 9:
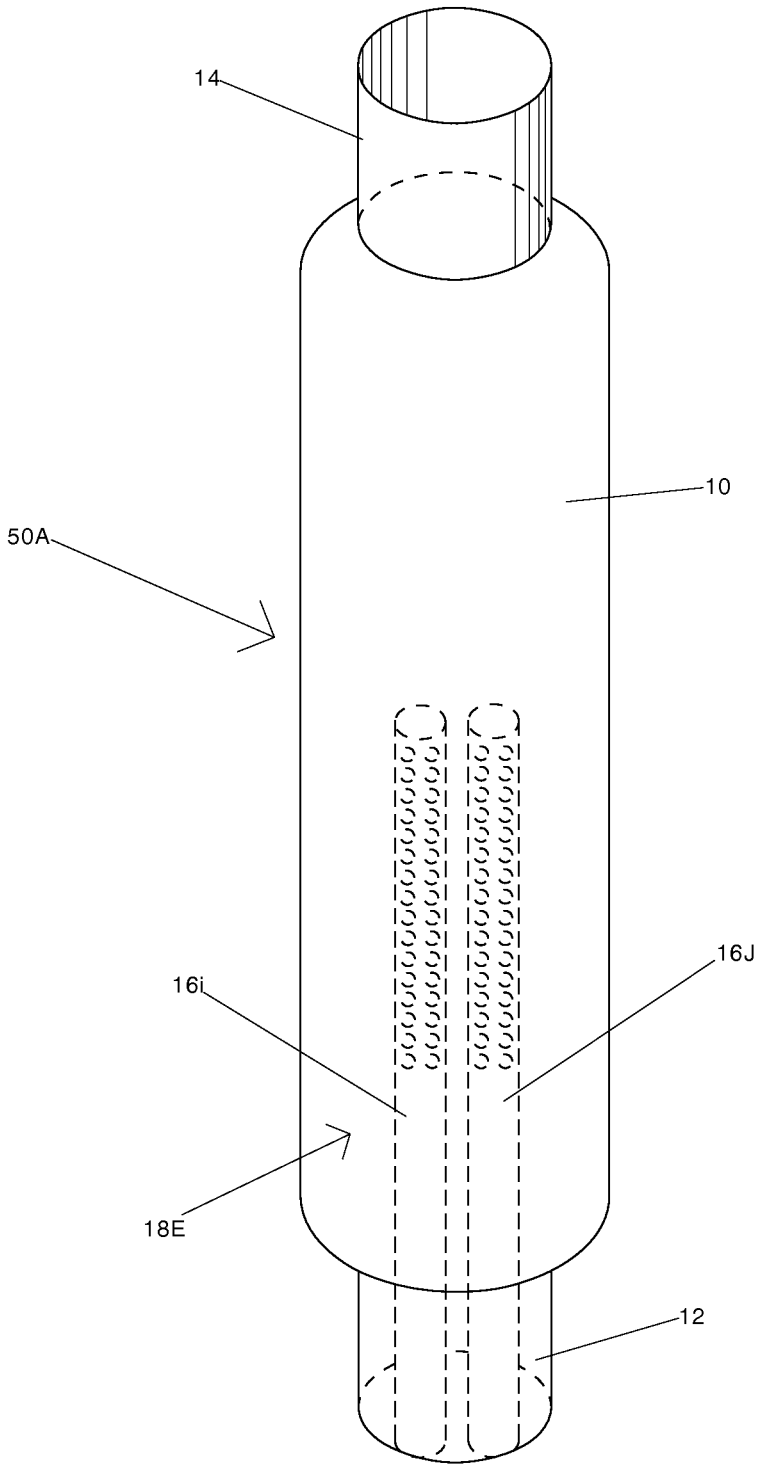
FIG. 9 shows an embodiment with perforated cylindrical elongated members.

FIG. 9—Ninth Embodiment

FIG. 9 shows the small cylindrical-bodied case 50A, and elongated member assembly 18E, comprised of elongated members 16*i* and 16J, attached to the inlet 12. The elongated members 16*i* and 16J are both cylindrical in shape, open on both ends, and perforated.

OPERATION

FIG. 9—Ninth Embodiment

FIG. 9 operates the same as FIG. 7, but with elongated members 16*i* and 16J, which are both perforated and cylindrical. This allows exhaust gasses to flow in and out of the members, resulting in different sound characteristics than those produced by other embodiments.

DETAILED DESCRIPTION

Figure 10:
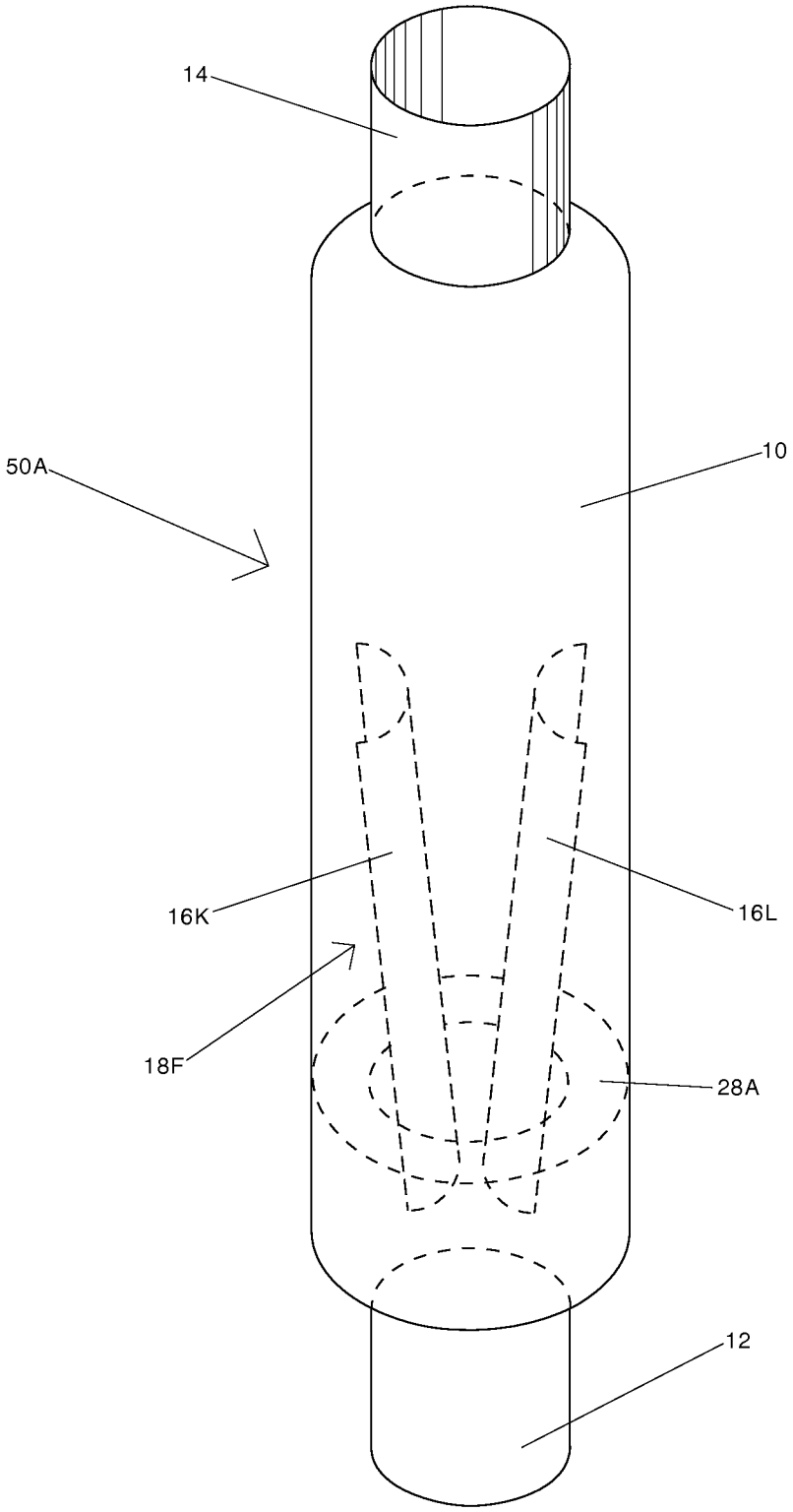
FIG. 10 shows an embodiment with elongated members attached inside a muffler body (in this case, using a holding ring).

FIG. 10—Tenth Embodiment

FIG. 10 shows the small cylindrical-bodied case 50A, and an elongated member assembly 18F, comprised of two elongated members 16K and 16L, attached to a holding ring 28A, which is in turn attached to the small cylindrical body 10.

OPERATION

FIG. 10—Tenth Embodiment

FIG. 10 operates the same as FIG. 1, but instead of elongated members 16A and 16B, this embodiment uses elongated members 16K and 16L, attached to the holding ring 28A, which in turn is attached to the small cylindrical body 10. This results in different sound characteristics than those produced by other embodiments.

DETAILED DESCRIPTION

Figure 11:
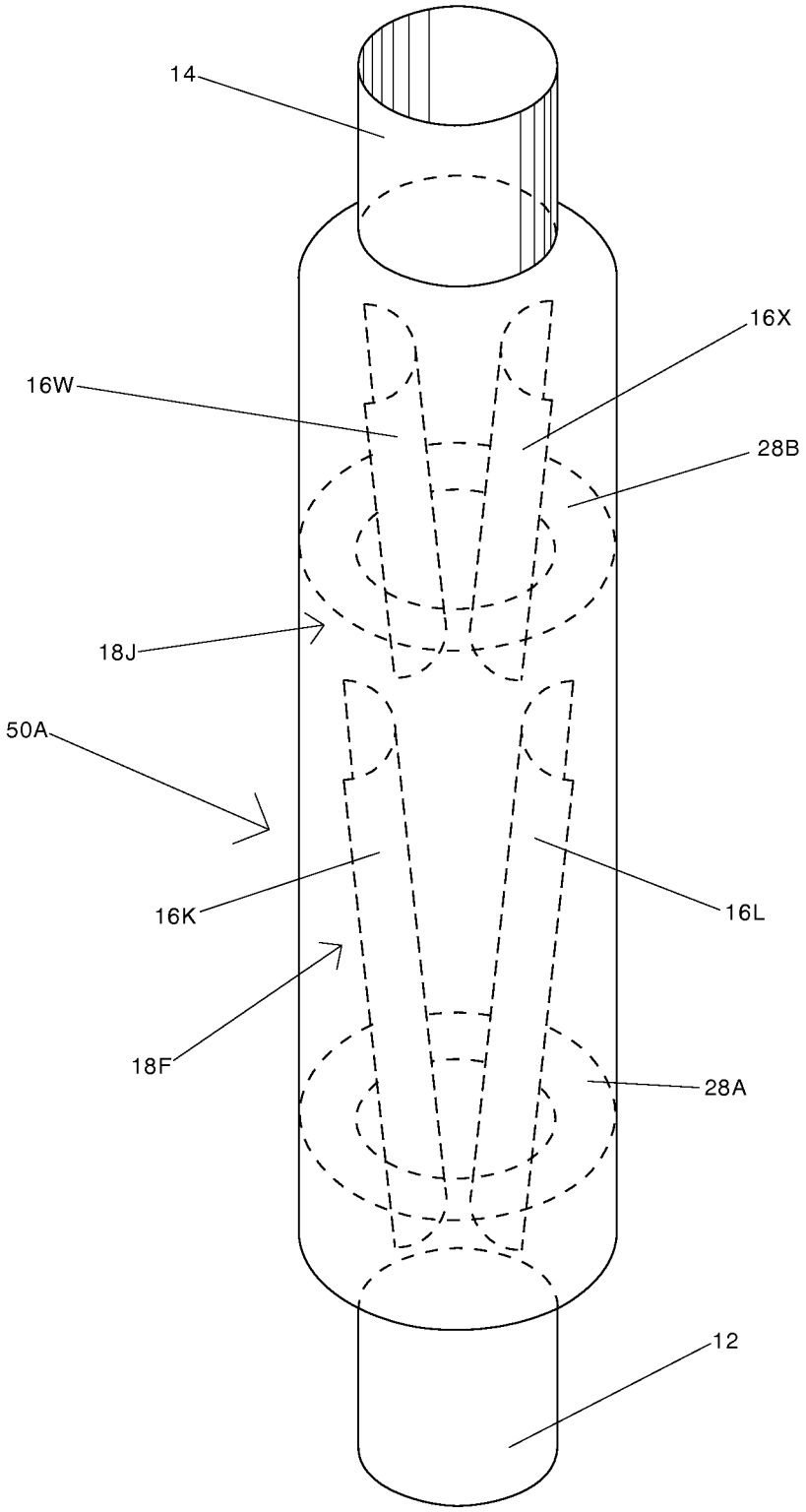
FIG. 11 shows an embodiment with multiple sets of elongated members attached to the body (in this case, using a holding ring).

FIG. 11—Eleventh Embodiment

FIG. 11 shows the same elements as FIG. 10, with the addition of another elongated member assembly 18J, comprised of two elongated members 16W and 16X, and a holding ring 28B.

OPERATION

FIG. 11—Eleventh Embodiment

FIG. 11 operates the same as FIG. 10, but with a second elongated member assembly 18J. This allows the exhaust gasses to be further manipulated, resulting in different sound characteristics than those produced by other embodiments.

DETAILED DESCRIPTION

Figure 12:
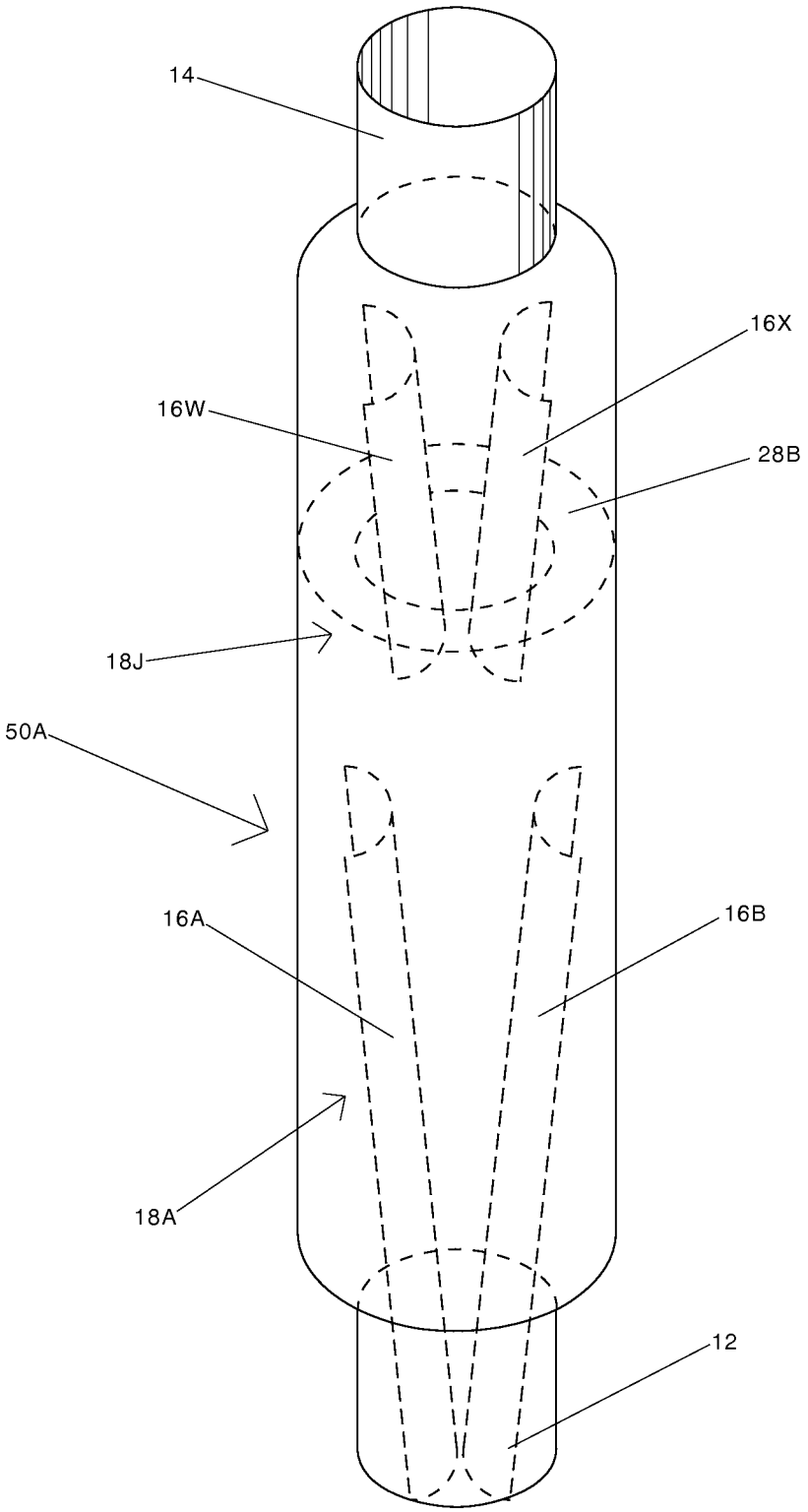
FIG. 12 shows an embodiment with a set of elongated members attached to an inlet, and a set of elongated members attached to the body (in this case, using a holding ring).

FIG. 12—Twelfth Embodiment

FIG. 12 shows the same elements as FIG. 1, with the addition of another elongated member assembly 18J, comprised of elongated members 16W and 16X, and the holding ring 28B.

OPERATION

FIG. 12—Twelfth Embodiment

FIG. 12 operates the same as FIG. 11, but with one of the elongated member assemblies 18A attached to the inlet 12. This results in different sound characteristics than those produced by other embodiments.

DETAILED DESCRIPTION

Figure 13:
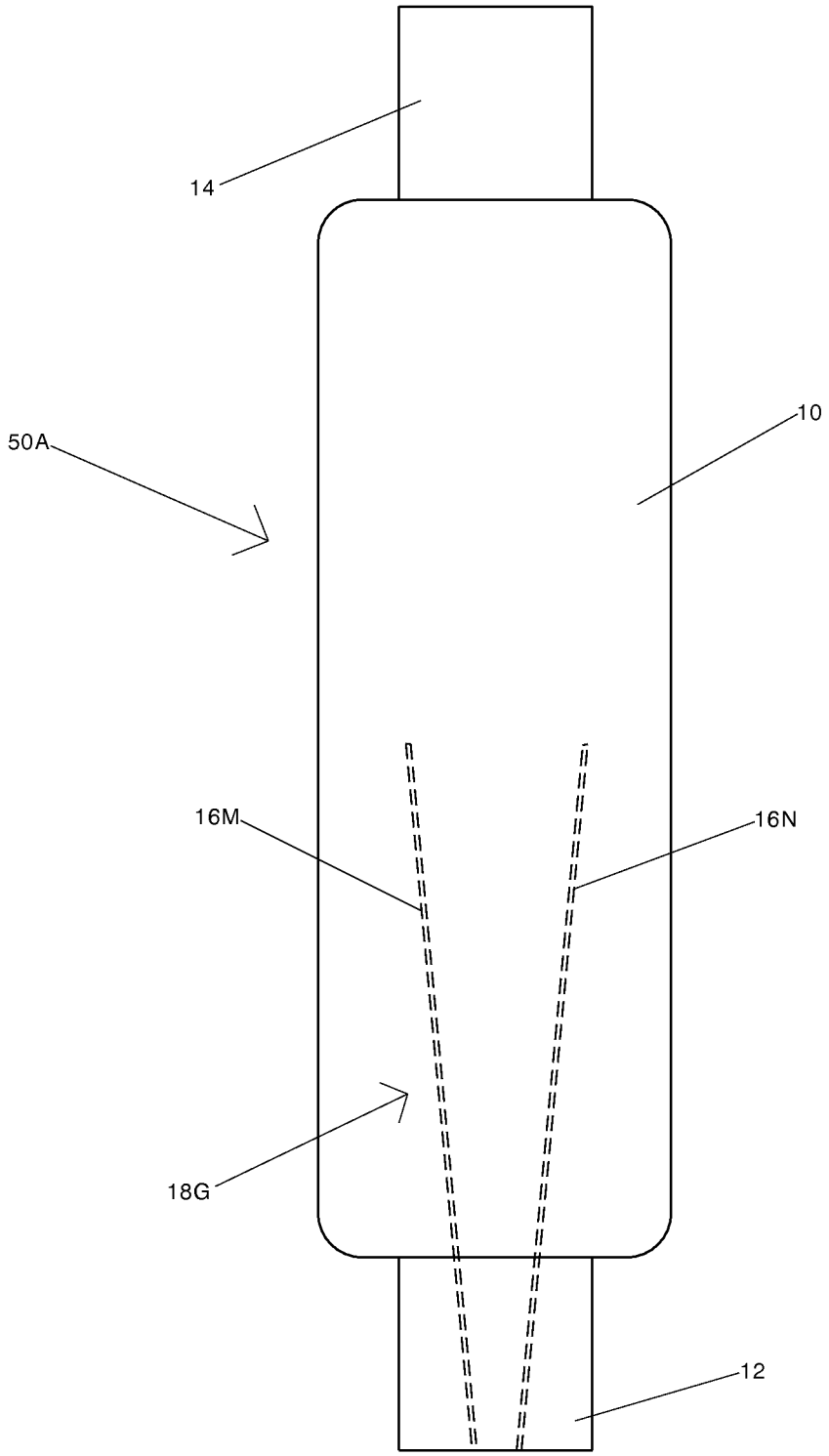
FIG. 13 is a plan view of an embodiment with flat (technically polyhedral) elongated members.

FIG. 13—Thirteenth Embodiment

FIG. 13 shows a plan view of an embodiment comprising of small cylindrical-bodied case 50A, and an elongated member assembly 18G, comprised of two elongated members 16M and 16N, attached inside the inlet 12. Elongated members 16M and 16N are flat (technically polyhedral, as all physical objects have depth).

OPERATION

FIG. 13—Thirteenth Embodiment

FIG. 13 operates the same as FIG. 1, but with elongated member assembly 18G in place of 18A. This results in different sound characteristics than those produced by other embodiments.

DETAILED DESCRIPTION

Figure 14:
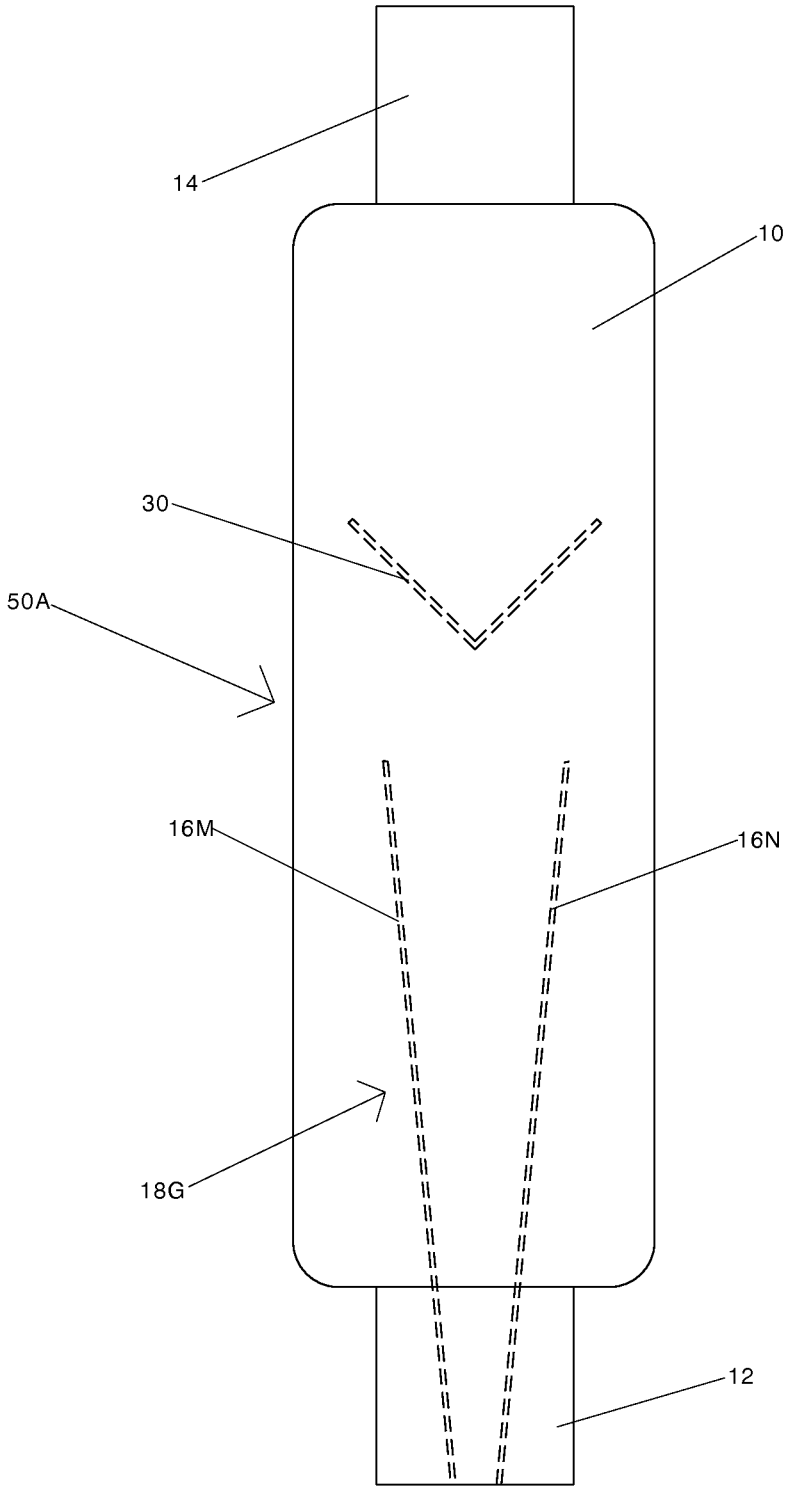
FIG. 14 shows an embodiment with a "v"-shaped deflection baffle (attached to the body).

FIG. 14—Fourteenth Embodiment

FIG. 14 shows the same elements of FIG. 13, with the addition of a body-mounted "v"-shaped deflection baffle 30.

OPERATION

FIG. 14—Fourteenth Embodiment

FIG. 14 operates the same as FIG. 13, with the addition of body-mounted "v"-shaped deflection baffle 30. Exhaust gasses are forced to go around the baffle, which slows down the flow, as well as creates noise canceling deflection between baffle 30 and the small cylindrical body 10.

DETAILED DESCRIPTION

Figure 15:
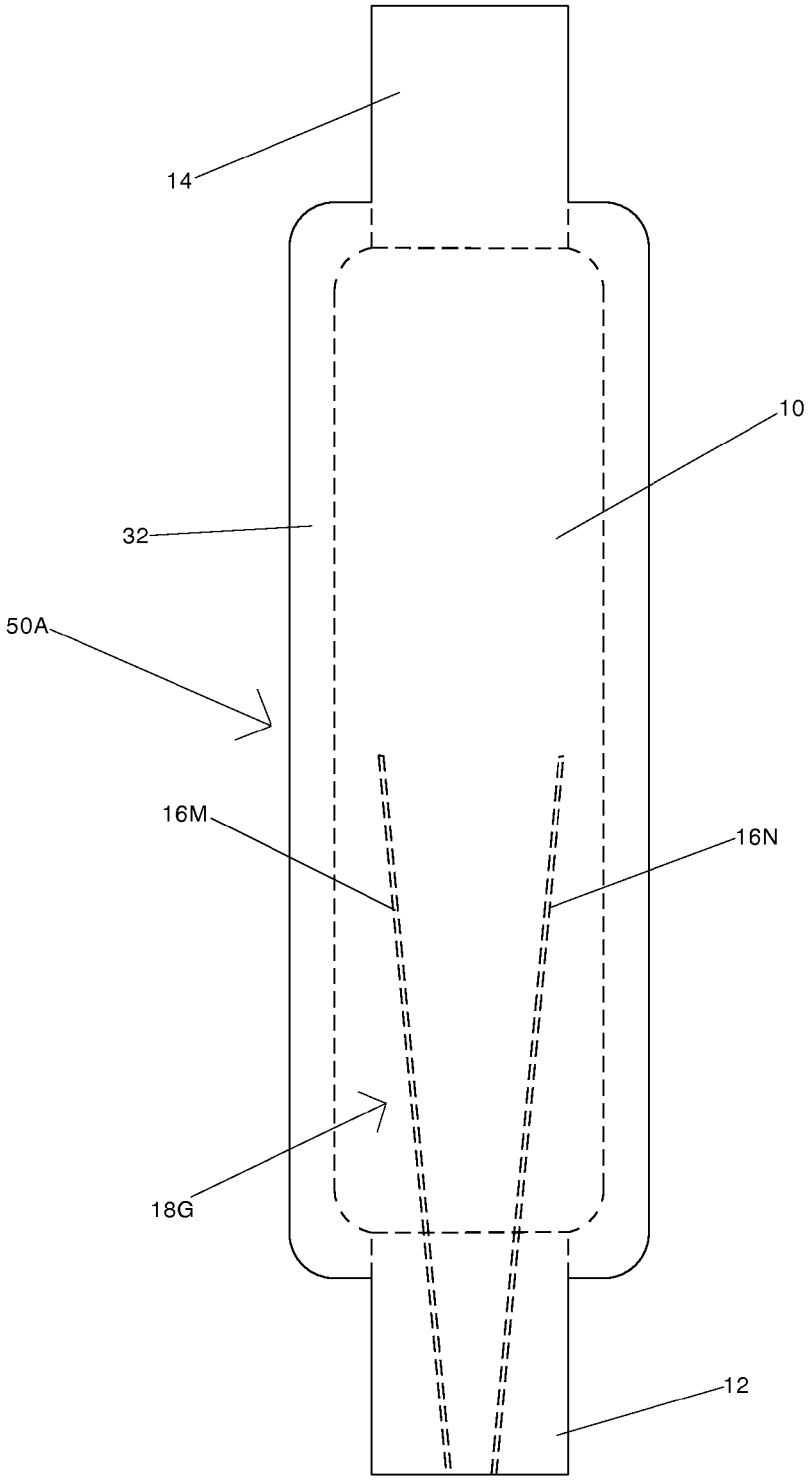
FIG. 15 shows an embodiment with sound absorbent material.

FIG. 15—Fifteenth Embodiment

FIG. 15 shows the same elements as FIG. 13, with the addition of sound absorbent material 32 (examples of sound absorbent materials include (but is not limited to) fiberglass packing and steel wool).

OPERATION

FIG. 15—Fifteenth Embodiment

FIG. 15 operates the same as FIG. 13, with the addition of sound absorbent material 32. Some of the exhaust gasses are caught by the sound absorbent material 32, which results in lower volume and altered tone quality.

DETAILED DESCRIPTION

Figure 16:
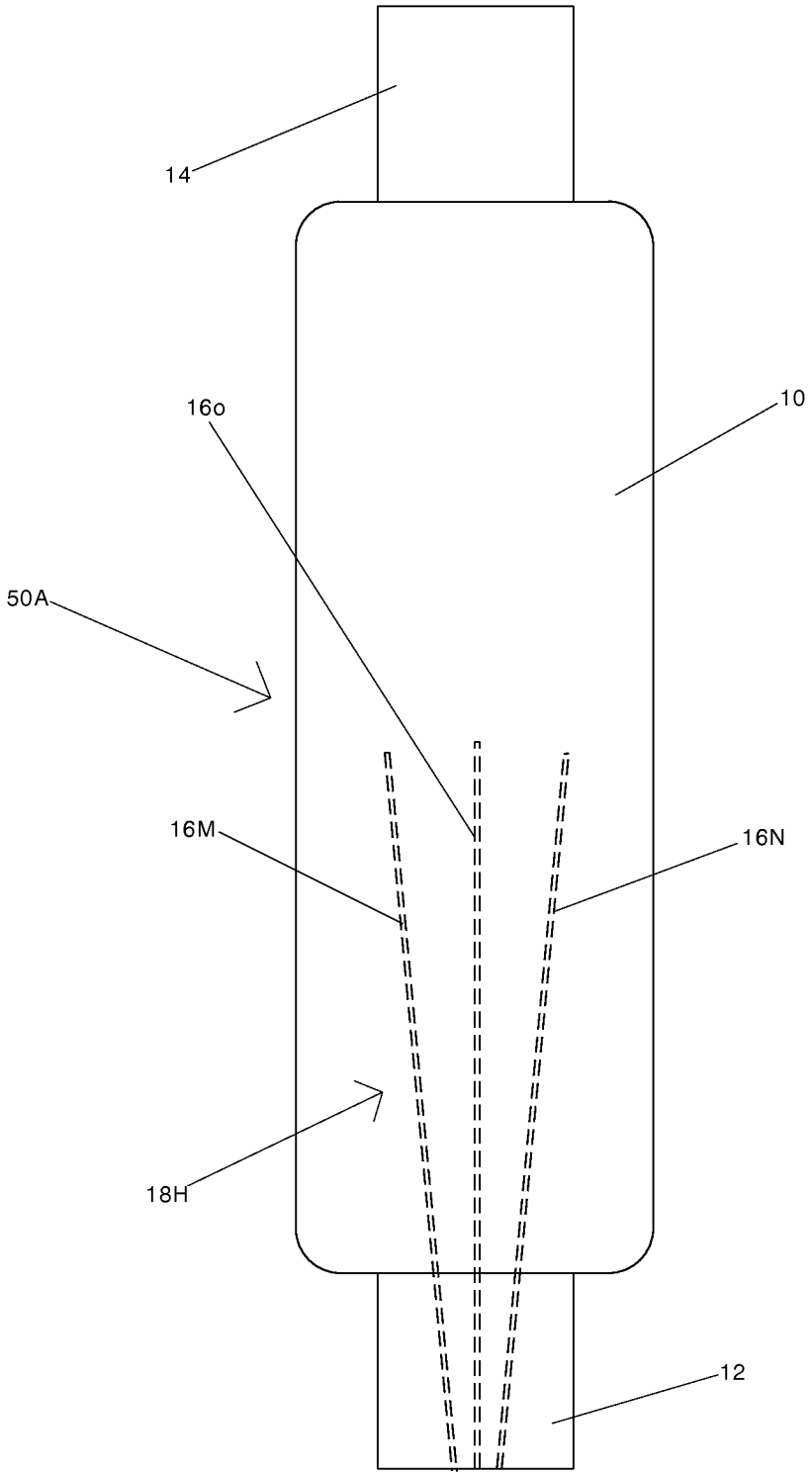
FIG. 16 shows an embodiment with three elongated members.

FIG. 16—Sixteenth Embodiment

FIG. 16 shows the same elements as FIG. 13, with the addition of a third elongated member 16*o*, which along with elongated members 16M and 16N, make up the elongated member assembly 18H.

OPERATION

FIG. 16—Sixteenth Embodiment

FIG. 16 operates the same as FIG. 13, with the addition of a third elongated member 16*o*. This results in different resonant frequencies than those produced by the embodiment illustrated in FIG. 13.

DETAILED DESCRIPTION

Figure 17:
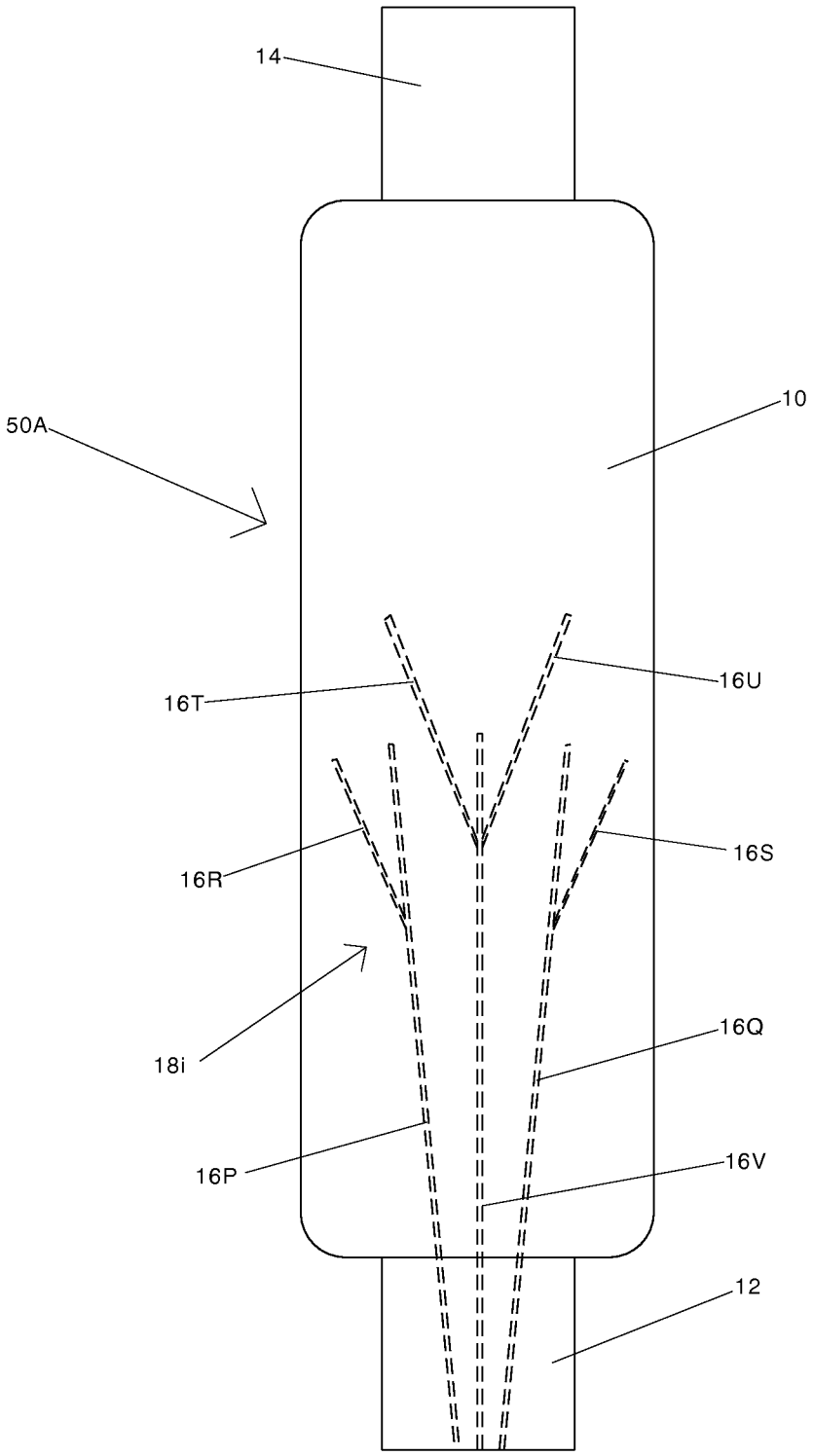
FIG. 17 shows an embodiment with multiple, branching elongated members.

FIG. 17—Seventeenth Embodiment

FIG. 17 shows a plan view of an embodiment comprising of small cylindrical-bodied case 50A, and the elongated members assembly 18*i* (which is comprised of elongated members 16P, 16Q, 16V, 16R, 16S, 16T, and 16U). Elongated members 16R, 16S, 16T, and 16U are referred to as "branches" because they stem from elongated members 16P, 16Q, and 16V, respectively. Elongated member assembly 18*i* is attached to the inlet 12.

OPERATION

FIG. 17—Seventeenth Embodiment

FIG. 17 operates the same as FIG. 1, with elongated member assembly 18*i* in the place of elongated member assembly 18A. Elongated members 16P, 16Q, 16R, 16S, 16T, and 16U all interact with each other as exhaust gasses flow past them, resulting in a complex array of resonant frequencies.

DETAILED DESCRIPTION

Figure 18:
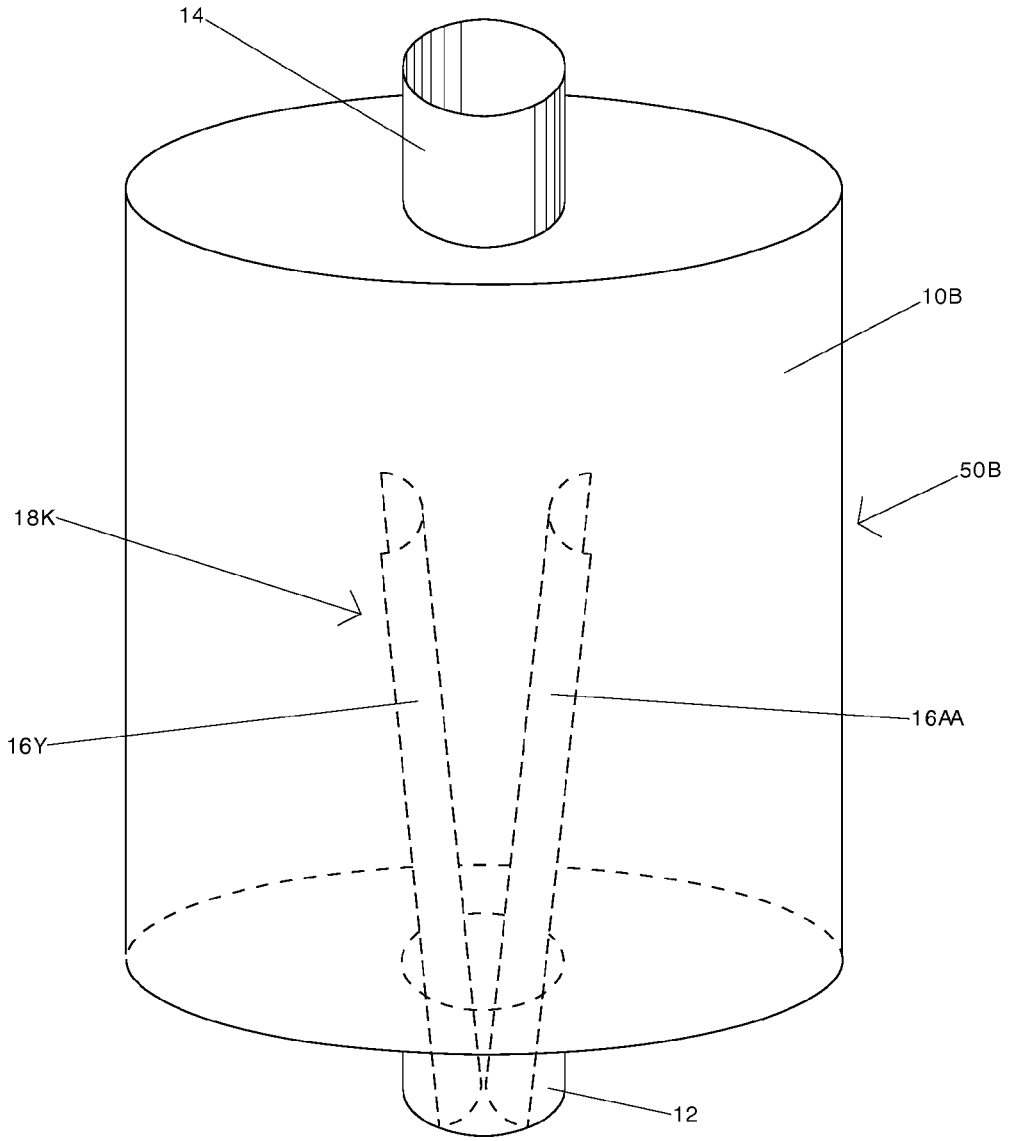
FIG. 18 shows an embodiment with a large cylindrical-bodied case.

FIG. 18—Eighteenth Embodiment

FIG. 18 shows a large cylindrical-bodied case 50B, comprised of a large cylindrical body 10B, inlet 12, and outlet 14. An elongated member assembly 18K, comprised of elongated members 16Y and 16AA, is attached inside the inlet 12.

OPERATION

FIG. 18—Eighteenth Embodiment

FIG. 18 operates the same as FIG. 1, with elongated member assembly 18K in the place of elongated member assembly 18A, the large cylindrical-bodied case 50B in the place of the small cylindrical-bodied case 50A, and the large cylindrical body 10B in the place of the small cylindrical body 10A. The large case results in different sound characteristics than those produced by other embodiments.

DETAILED DESCRIPTION

Figure 19:
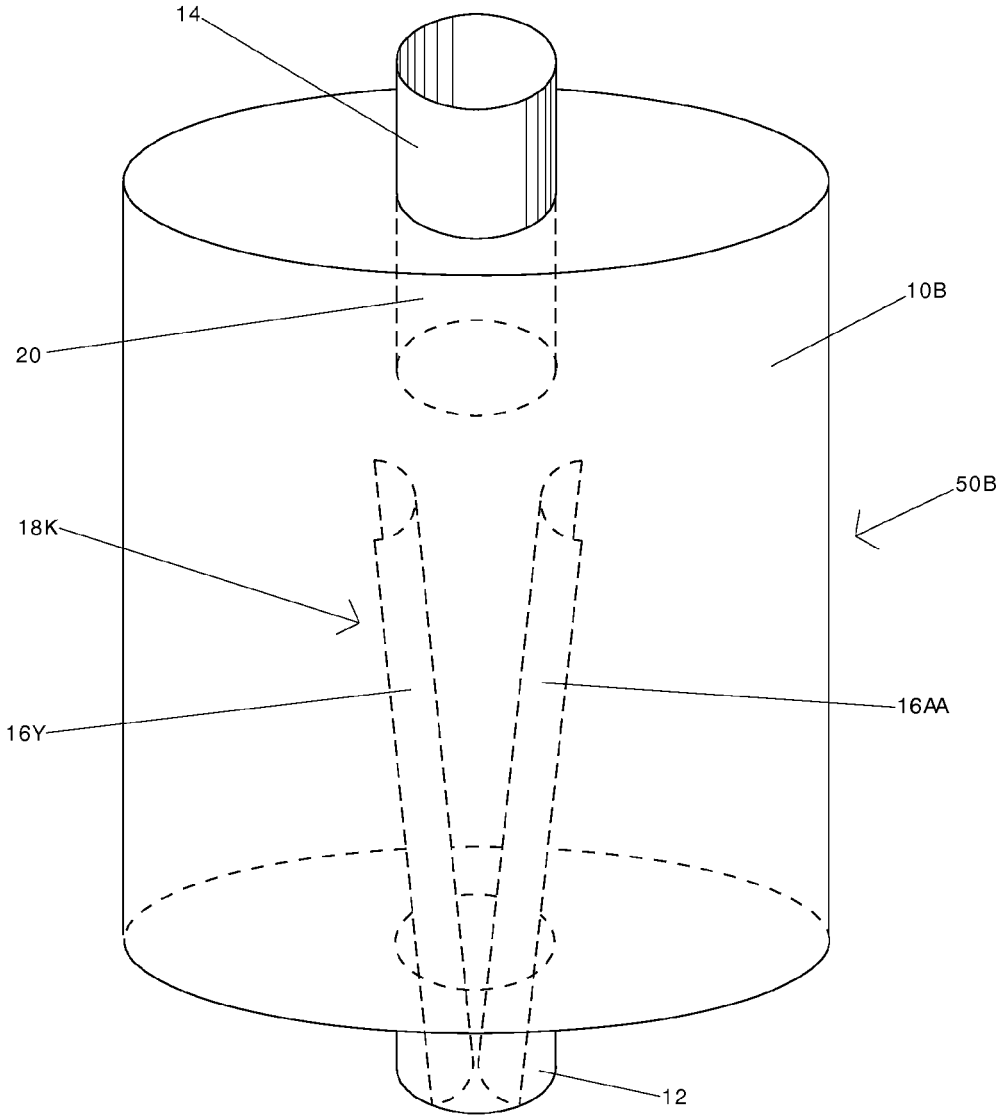
FIG. 19 shows an embodiment with a large cylindrical-bodied and a deflection baffle.

FIG. 19—Nineteenth Embodiment

FIG. 19 shows the same elements as FIG. 18, with the addition of deflection baffle 20.

OPERATION

FIG. 19—Nineteenth Embodiment

FIG. 19 operates the same as FIG. 18, with the addition of deflection baffle 20. After passing the elongated member assembly 18K, some of the exhaust gasses flow directly out, while some are forced to the sides of the deflection baffle 20, where they deflect between the baffle 20 and large cylindrical body 10B. This results in further noise cancellation. The gasses eventually flow out of the case 50A via the outlet 14.

DETAILED DESCRIPTION

Figure 20:
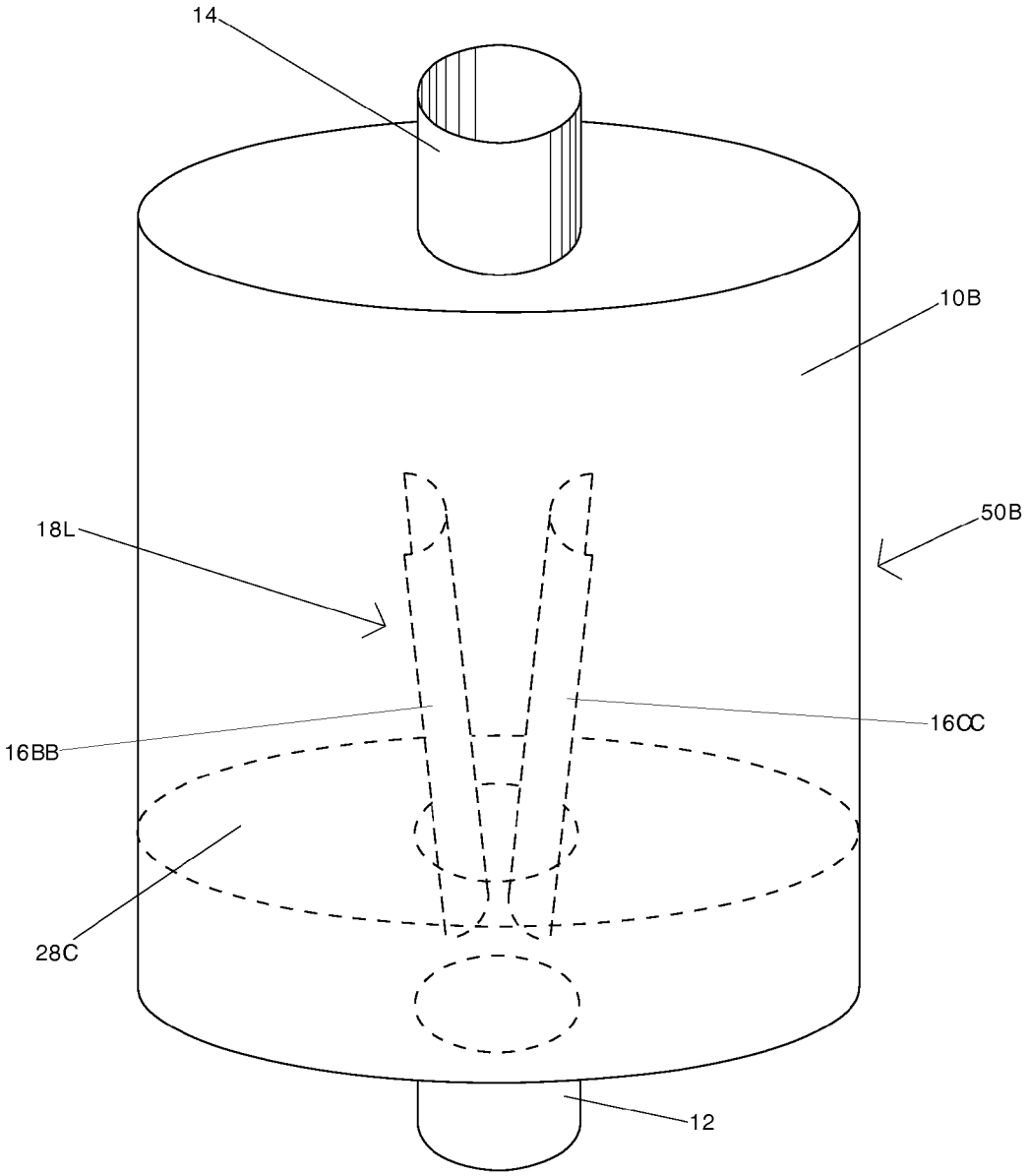
FIG. 20 shows an embodiment with a large cylindrical-bodied case and elongated members attached to the body (in this case with a holding ring).

FIG. 20—Twentieth Embodiment

FIG. 20 shows the large cylindrical-bodied case 50B, an elongated member assembly 18L (comprised of elongated members 16BB and 16CC), and holding ring 28C (which is attached to the large cylindrical body 10B).

OPERATION

FIG. 20—Twentieth Embodiment

FIG. 20 operates the same as FIG. 18, but instead of elongated members 16Y and 16AA, this embodiment uses elongated members 16BB and 16CC, attached to the holding ring 28C, which in turn is attached to the large cylindrical body 10B. This results in different sound characteristics than those produced by other embodiments.

DETAILED DESCRIPTION

Figure 21:
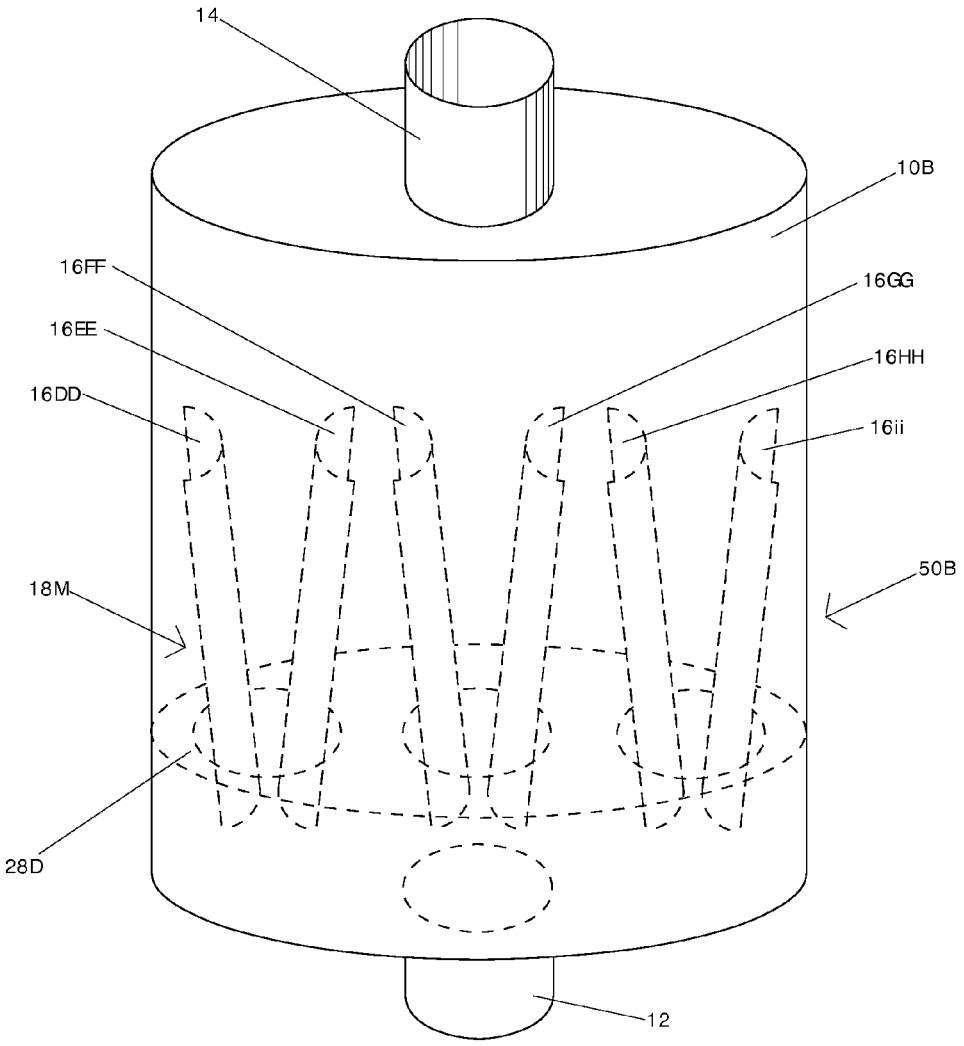
FIG. 21 shows an embodiment with a large cylindrical-bodied case and multiple sets of elongated members.

FIG. 21—Twenty First Embodiment

FIG. 21 shows the large cylindrical-bodied case 50B, an elongated member assembly 18M (comprised of elongated members 16DD, 16EE, 16FF, 16GG, 16HH, 16*ii*, and holding ring 28D). The elongated member assembly 18M is attached to the body 10B.

OPERATION

FIG. 21—Twenty First Embodiment

After entering the large cylindrical body 10B via the inlet 12, the exhaust gasses flow into one of the three holes in holding ring 28D. Inside each hole is a set of elongated members. As the exhaust gasses pass through the elongated members, they vibrate amongst each other, creating complex resonant frequencies. The exhaust gasses then exit through outlet 14.

DETAILED DESCRIPTION

Figure 22:
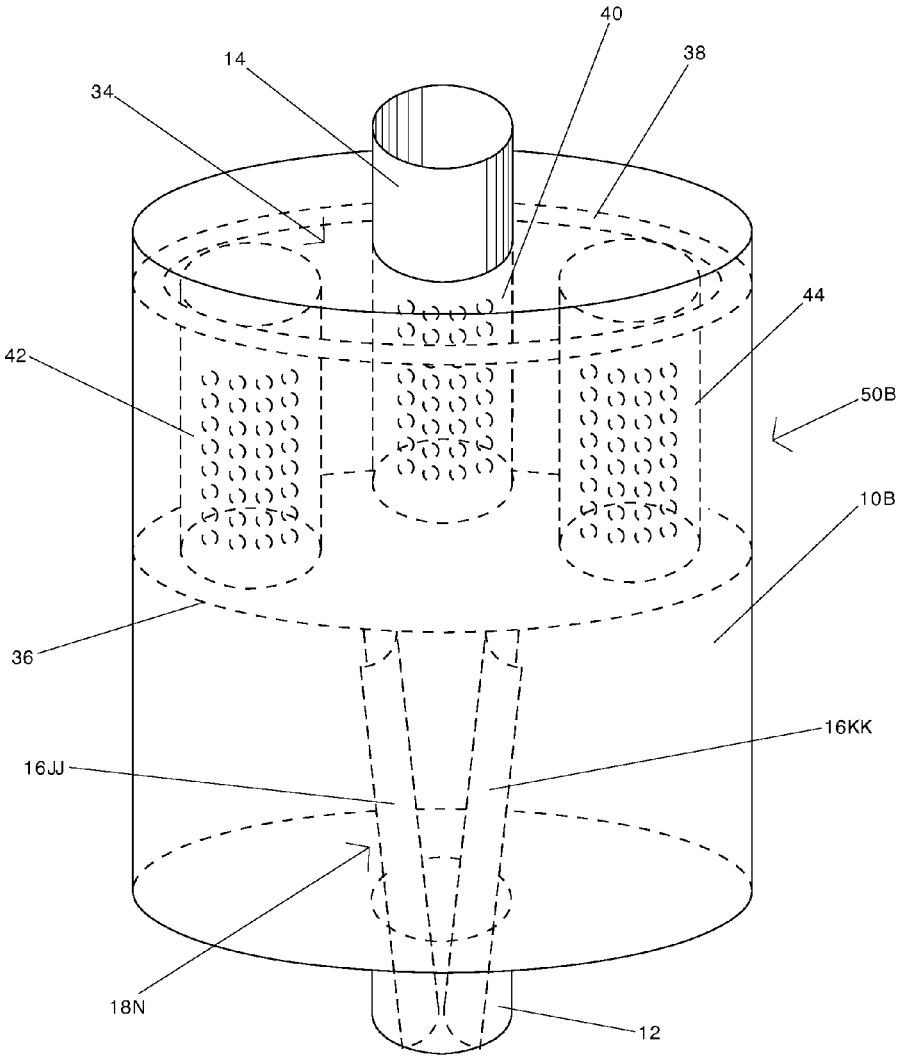
FIG. 22 shows a perspective view of an embodiment with a full baffling system.
Figure 23:
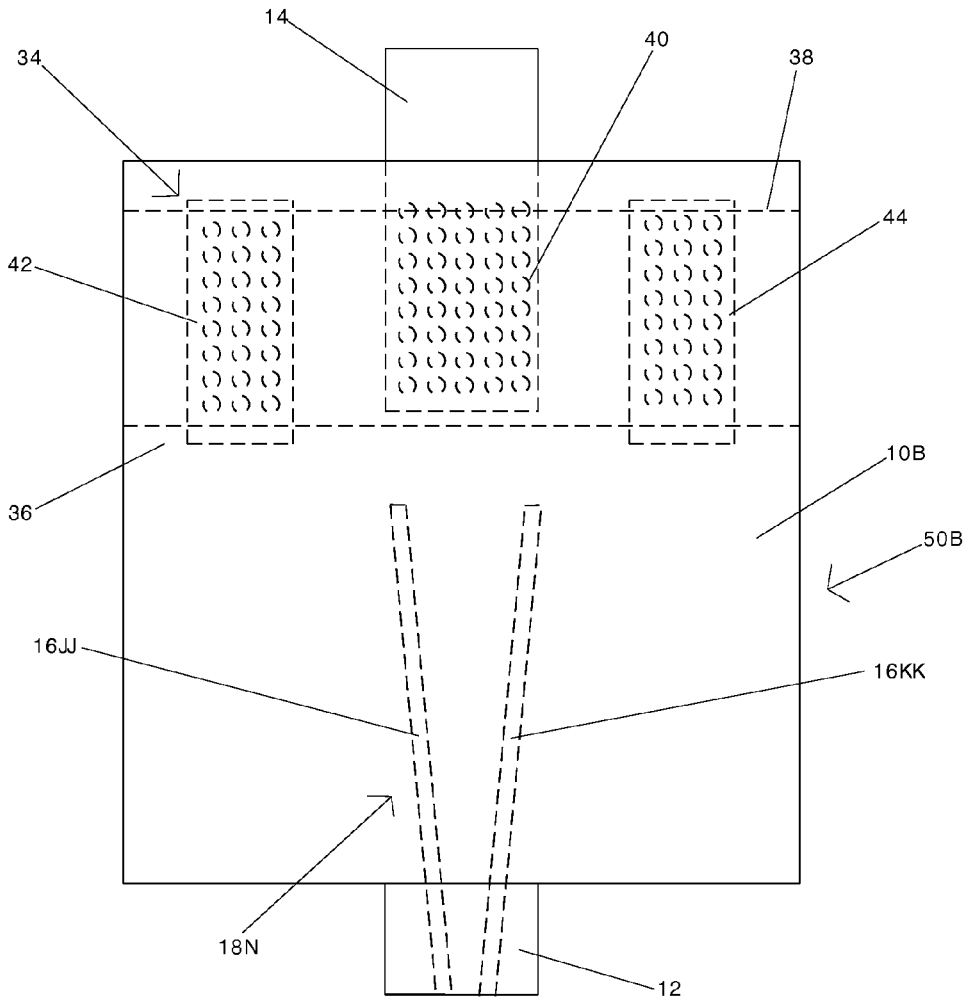
FIG. 23 shows a plan view of the embodiment in FIG. 22.

FIG. 22 AND FIG. 23—Twenty Second Embodiment

FIG. 22 and FIG. 23 show the large cylindrical-bodied case 50B, an elongated member assembly 18N (comprised of elongated members 16JJ and 16KK and attached to the inlet 12). In addition, FIGS. 22 and 23 show a baffle assembly 34, comprised of a baffle assembly front cradle 36, baffle assembly holding ring 38, perforated baffle 1 40, perforated baffle 2 42, and perforated baffle 3 44.

OPERATION

FIG. 22 AND FIG. 23—Twenty Second Embodiment

After passing by the elongated member assembly 18N, the exhaust gasses flow into either perforated baffle 2 42 or perforated baffle 3 44. From there the exhaust gas either flows out of the perforations, or travels to the end of their respective baffles before hitting the large cylindrical body 10B, then turning around and flowing into perforated baffle 1 40 (this is possible because the baffle assembly holding ring 38 is open in its center). The exhaust gasses then exit through outlet 14.

DETAILED DESCRIPTION

Figure 24:
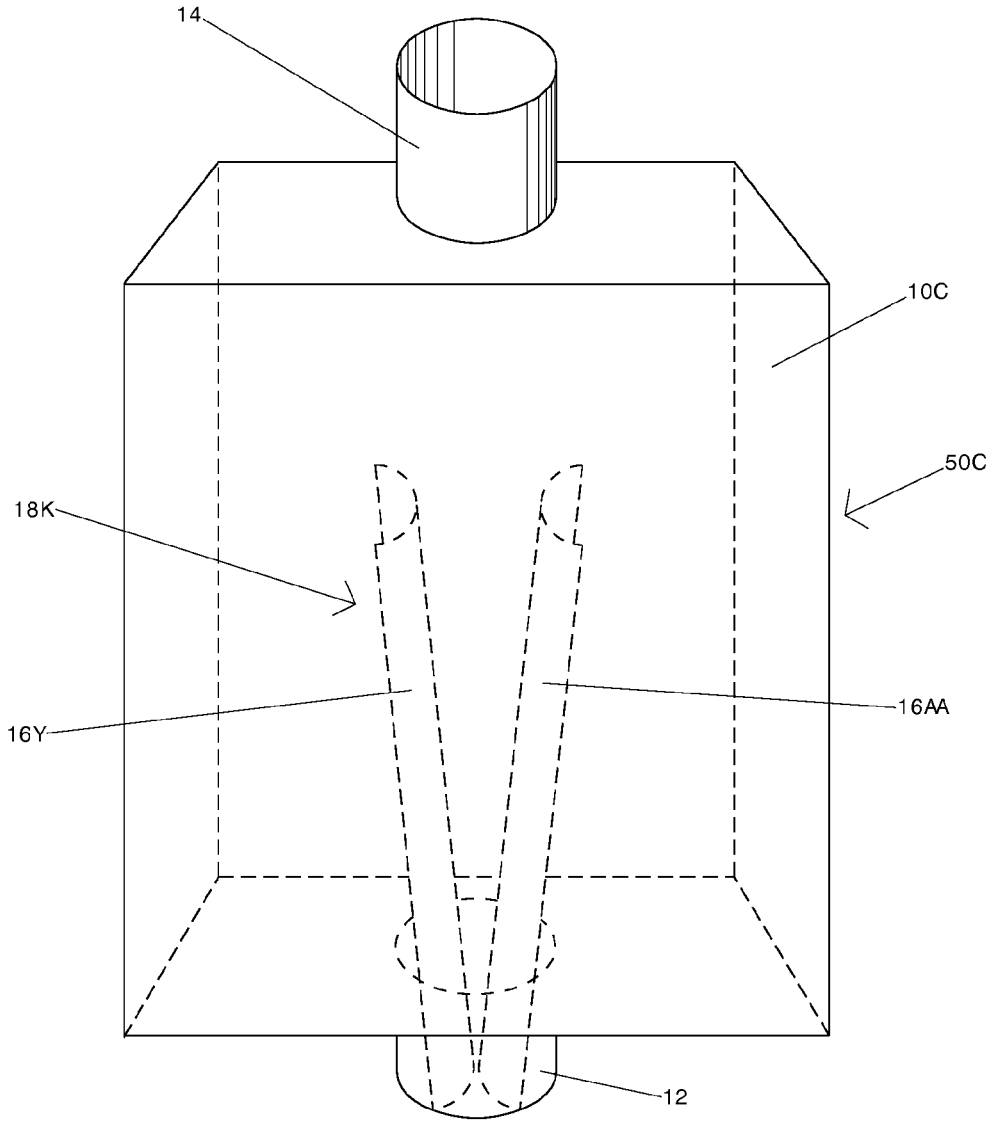
FIG. 24 shows an embodiment with a polyhedron case.

FIG. 24—Twenty Third Embodiment

FIG. 24 shows a polyhedral-bodied case 50C, comprised of a polyhedral body 10C, inlet 12, and outlet 14. An elongated member assembly 18K, comprised of elongated members 16Y and 16AA, is attached inside the inlet 12.

OPERATION

FIG. 24—Twenty Third Embodiment

FIG. 24 operates the same as FIG. 18, with polyhedral-bodied case 50C in place of the large cylindrical-bodied case 50B.

DETAILED DESCRIPTION

Figure 25:
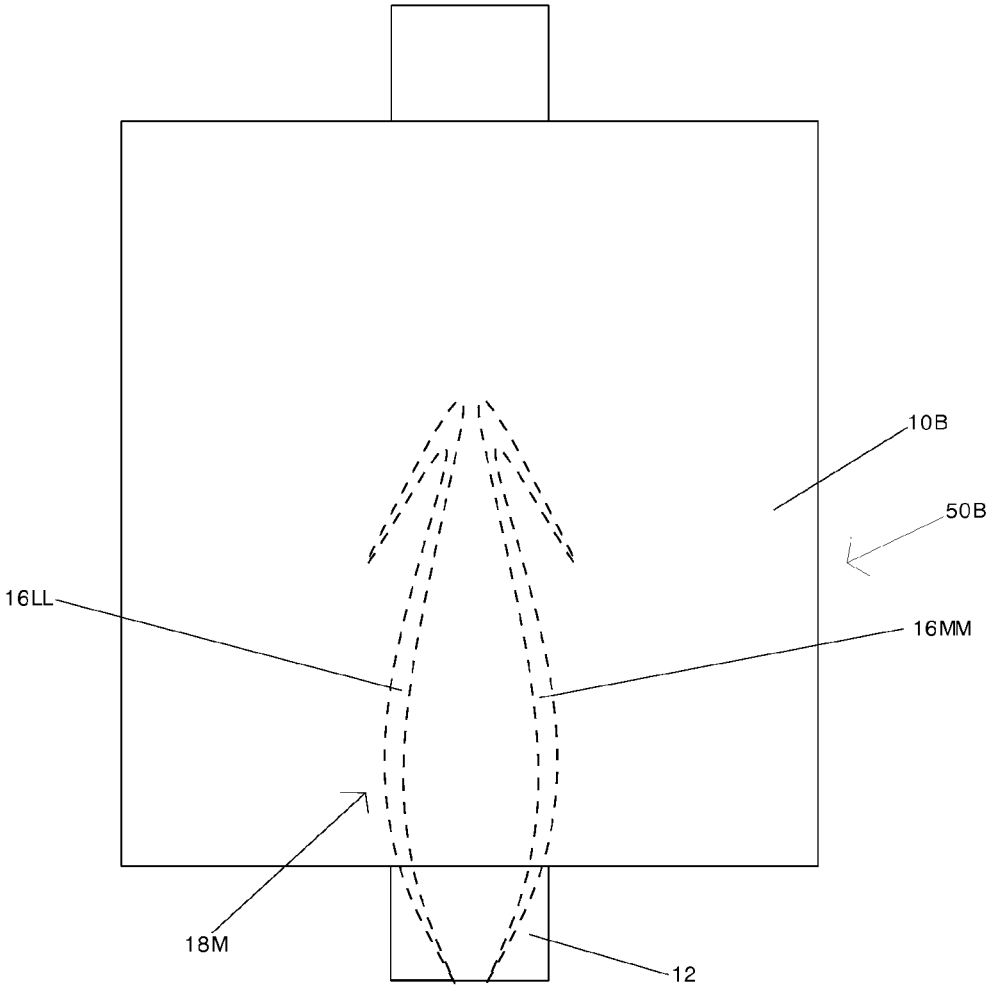
FIG. 25 shows an embodiment with curved elongated members

FIG. 25—Twenty Fourth Embodiment

FIG. 25 shows the same elements as FIG. 18, with elongated member assembly 18M in place of elongated member assembly 18K. Elongated member assembly 18M is comprised of elongated members 16LL and 16MM, which are both curved.

OPERATION

FIG. 25—Twenty Fourth Embodiment

FIG. 25 operates the same as FIG. 18, with elongated member assembly 18M in place of elongated member assembly 18K. Because the members comprising elongated member assembly 18K are curved, different sounds are created in comparison to other embodiments.

CONCLUSIONS, RAMIFICATIONS, AND SCOPE

Accordingly, the reader will see that resonance generating mufflers of the various embodiments are capable of generating tones that are noise canceling and/or sound enhancing. These mufflers are capable of extremely low back pressure, even when used to silence, and are capable of extraordinarily pleasing tones when used to enhance engine sound. Furthermore, a resonance generating muffler has additional advantages such as:

- Providing a crisp, natural tone.
- A lack of annoying low frequency "drone".
- The potential to reduce or eliminate popping exhaust sounds.
- The potential to specifically reduce unpleasant tones without sounding dull and artificial.
- The ability to solve the problem of high back pressure (and its consequential reduction of efficiency) in mufflers intended to silence.

Although the above description provides many specificities, they should not be construed as limiting the scope of the invention or its embodiments. Rather, these specificities should be seen merely as examples of what is possible under the claims. Many other variations are possible as well. For example, any body shape may be used. In addition, any number of elongated members may be used, in any combination or form, as long as they fall under the description in the claims. Any combination of sound baffles, sound absorbent material, and/or other sound altering devices (for example, active electronic noise canceling) may be used in addition to the members, providing such implementation is legal under intellectual property law.

Accordingly, scope should be determined not by the examples given, but by the appended claims and their legal equivalents.

We claim:

1. A muffler for use with an internal combustion engine for generating resonance to cancel or enhance engine noise, comprising:

a case having a body defining an internal area, said case including an inlet configured to provide access into said body and an outlet displaced from said inlet and configured to provide access out of said body; and a plurality of elongated members positioned in said body, said plurality of elongated members having respective first portions attached to said case and positioned in a manner allowing exhaust to pass by and directly excite the elongated members to produce resonant tones, and having respective free ends extending into said internal area away from said respective first portions;

wherein said plurality of elongated members are separated from one another and from said case except at a final point of attachment of said respective first portions to said case;

wherein said plurality of elongated members are immediately adjacent and immediately proximate to each other at the final point of attachment;

wherein said plurality of elongated members have a length extending away from said final point of attachment of said respective immediately proximate first portions such that said plurality of elongated members interact to provide a predetermined resonance when contacted by flowing exhaust gasses, whereby altering sound produced by said flowing exhaust gasses.

2. The muffler of claim 1 wherein said elongated members are straight.

3. The muffler of claim 1 wherein said elongated members are curved.

4. The muffler of claim 1 wherein said elongated members are cylindrical.

5. The muffler of claim 1 wherein said elongated members are partial cylinders.

6. The muffler of claim 1 wherein said elongated members are polyhedrons.

7. The muffler of claim 1 wherein said elongated members have elongated member branches.

8. The muffler of claim 1 wherein said elongated members are attached to at least one said inlet.

9. The muffler of claim 1 wherein said elongated members are attached to at least one said outlet.

10. The muffler of claim 1 wherein said elongated members are attached to at least one said body.

11. The muffler of claim 1, further including at least one sound altering device.

12. The muffler of claim 11 wherein said sound altering device is at least one sound baffle.

13. The muffler of claim 11 wherein said sound altering device is sound absorbent material.

14. The muffler of claim 1 wherein said elongated members are constructed of steel.

15. The muffler of claim 1, further comprising another elongated member that includes a free end displaced from said respective first portions of said plurality of elongated members, said free end of said another elongated member having a v-shaped tip that slows down exhaust gasses so as to change a resonance generated thereby when contacted by the exhaust gases.

16. The muffler of claim 1, wherein said unattached portions of said plurality of said elongated members and said free ends thereof extend about 20 cm into said interior area of said body and have a generally half-pipe configuration so as to enhance engine sound.

* * * * *